US007479954B2

(12) United States Patent
Tsuchiya

(10) Patent No.: US 7,479,954 B2
(45) Date of Patent: Jan. 20, 2009

(54) POWER SUPPLY CIRCUIT, DRIVING DEVICE, ELECTRO-OPTIC DEVICE, ELECTRONIC APPARATUS, AND METHOD OF SUPPLYING DRIVING-VOLTAGES

(75) Inventor: Masahiko Tsuchiya, Nagano (JP)

(73) Assignee: Seiko Epson Corporation (JP)

( * ) Notice: Subject to any disclaimer, the term of this patent is extended or adjusted under 35 U.S.C. 154(b) by 683 days.

(21) Appl. No.: 11/211,372

(22) Filed: Aug. 25, 2005

(65) Prior Publication Data

US 2006/0044253 A1 Mar. 2, 2006

(30) Foreign Application Priority Data

Aug. 26, 2004 (JP) ..... 2004-246847

(51) Int. Cl.
*G09G 5/00* (2006.01)

(52) U.S. Cl. ..... 345/211; 345/95; 345/208

(58) Field of Classification Search ..... 345/50, 345/87, 94, 95, 98, 99, 100, 208–213
See application file for complete search history.

(56) References Cited

U.S. PATENT DOCUMENTS

| | | | | |
|---|---|---|---|---|
| 6,151,005 | A * | 11/2000 | Takita et al. | 345/89 |
| 6,262,704 | B1 * | 7/2001 | Kurumisawa et al. | 345/98 |
| 6,496,174 | B2 * | 12/2002 | Kurumisawa et al. | 345/98 |
| 6,522,319 | B1 * | 2/2003 | Yamazaki | 345/103 |
| 6,750,839 | B1 * | 6/2004 | Hogan | 345/98 |
| 6,806,860 | B2 * | 10/2004 | Saito et al. | 345/98 |
| 6,839,043 | B2 * | 1/2005 | Nakajima | 345/87 |
| 6,900,788 | B2 * | 5/2005 | Yamazaki | 345/103 |
| 7,019,730 | B2 | 3/2006 | Tsuchiya | |

(Continued)

FOREIGN PATENT DOCUMENTS

| | | |
|---|---|---|
| JP | 2002-189454 | 7/2002 |

(Continued)

*Primary Examiner*—Richard Hjerpe
*Assistant Examiner*—Tom V Sheng
(74) *Attorney, Agent, or Firm*—Harness, Dickey & Pierce, P.L.C.

(57) ABSTRACT

A power supply circuit which generates driving voltages for an electro-optic device having a plurality of common electrodes and a plurality of segment electrodes with the use of multi-line driving in which four lines of common electrodes are simultaneously selected. The driving voltages are first through seventh driving voltages in which an i-th ($2 \leqq i \leqq 5$, and i is an integer) driving voltage is higher than an (i+1)th driving voltage. The power supply circuit includes: a common electrode driving-voltage generator circuit which generates the first and seventh driving voltages used for selection of the common electrodes at a positive side and a negative side on the basis of the fourth driving voltage; and a segment electrode driving-voltage generator circuit which generates the fourth driving voltage, the second and third driving voltages used for the segment electrodes at the positive side on the basis of the fourth driving voltage, and the fifth and the sixth driving voltages used for the segment electrodes at the negative side on the basis of the fourth driving voltage. The segment electrode driving-voltage generator circuit changes and outputs output potentials of only the third and fifth driving voltages from among the second through sixth driving voltages, while a voltage difference between the third and fourth driving voltages is kept equal to a voltage difference between the fourth and the fifth driving voltages.

9 Claims, 16 Drawing Sheets

U.S. PATENT DOCUMENTS 7,061,481 B2 6/2006 Tsuchiya
7,126,596 B1 * 10/2006 Hogan ..... 345/211
7,190,357 B2 * 3/2007 Ohta et al. ..... 345/204
7,307,610 B2 * 12/2007 Sakaguchi ..... 345/89
2003/0011558 A1 * 1/2003 Motegi et al. ..... 345/100

FOREIGN PATENT DOCUMENTS

WO WO 97/22036 6/1997

* cited by examiner

Selection pulse
COM1
COM2
SEG1
SEG2
ON
OFF
MV2
+V2
-V1
Disagreement "2"
Disagreement "0"
Disagreement "0"
Disagreement "1"

$$\begin{pmatrix} 1 & 1 & 1 & 1 \\ 1 & 1 & 0 & 0 \\ 1 & 0 & 0 & 1 \\ 1 & 0 & 1 & 0 \end{pmatrix}$$

FIG. 4A $$\begin{pmatrix} 0 & 0 & 1 & 0 \\ 0 & 1 & 0 & 0 \\ 1 & 0 & 0 & 0 \\ 0 & 0 & 0 & 1 \end{pmatrix}$$

FIG. 4B

| | V2 | V1 | VC | MV1 | MV2 |
|---|---|---|---|---|---|
| FIG. 9A | one time | — | three times | — | — |
| FIG. 9B | — | — | three times | — | one time |
| FIG. 9C | — | zero times | — | four times | — |
| FIG. 9D | — | one time | — | three times | — |
| FIG. 9E | — | two times | — | two times | — |
| FIG. 9F | — | three times | — | one time | — |
| FIG. 9G | — | four times | — | zero times | — |

POWER SUPPLY CIRCUIT, DRIVING DEVICE, ELECTRO-OPTIC DEVICE, ELECTRONIC APPARATUS, AND METHOD OF SUPPLYING DRIVING-VOLTAGES

Japanese Patent Application No. 2004-246847, filed on Aug. 26, 2004, is hereby incorporated by reference in its entirety.

BACKGROUND OF THE INVENTION

The present invention relates to a power supply circuit, a driving device, an electro-optic device, an electronic apparatus, and a method of supplying driving voltages.

In a simple-matrix type liquid crystal panel (an electro-optic device, in a broad sense), improvement in the response speed is attempted with a multi-line (Multi Line Selection, hereinafter abbreviated to MLS) driving method of simultaneously selecting a plurality of common electrodes (scanning electrodes, in a broad sense), and increasing in contrast and reduction in power consumption are attempted.

In this MLS driving method, an interval of selection period, in which a selection voltage is applied to a common electrode in one frame period, is narrowed and on the other hand, the same common electrode is selected a plurality of times in one frame period. Accordingly, the selection voltage of the common electrode can be lowered, and an average transmissivity of pixels can be improved, thus improving contrast of a liquid crystal panel. For this reason, the driving voltage for segment electrodes (signal electrodes, in a broad sense) is determined corresponding to a scanning pattern (an applied pattern, a selection pattern) of the selection voltage of common electrodes to be simultaneously selected. Then, turned on or off of a pixel is controlled by an effective voltage applied to the liquid crystal device in one frame period.

In the case where a simple-matrix type liquid crystal panel is driven with the MLS driving method of simultaneously selecting four lines of common electrodes, if a non-selection voltage for common electrodes and a center voltage VC for the driving voltage of segment electrodes are made in common, seven levels of voltages (V3, V2, V1, VC, MV1, MV2, MV3) will be required.

FIG. 18 shows a relationship of the seven levels of voltages in the case where the simple-matrix type liquid crystal panel is driven with the MLS driving method of simultaneously selecting four lines of common electrodes.

Here, the voltages V3 and MV3 are the selection voltages of the common electrode. The voltage VC is the non-selection voltage of the common electrode, and is the driving voltage for the segment electrode. The voltages V2, V1, MV1, and MV2 are the driving voltages for the segment electrode.

The voltage difference between the voltage V3 and the center voltage VC is denoted by $v_3$, the voltage difference between the voltage V2 and the center voltage VC by $v_2$, and the voltage difference between the voltage V1 and the center voltage VC by $v_1$. At this time, the voltage difference between the center voltage VC and the voltage MV3 is $v_3$, the voltage difference between the center voltage VC and the voltage MV2 is $v_2$, and the voltage difference between the center voltage VC and the voltage MV1 is $v_1$. Here, the voltage difference between the voltage V2 and the voltage V1 (=the voltage difference between the voltage MV1 and the voltage MV2) is equal to the voltage difference between the voltage V1 and the center voltage VC (=the voltage difference between the center voltage VC and the voltage MV1). International Patent Publication No. WO 97/22036 is an example of related art.

If the above-described driving voltages are applied to the segment electrode in an ideal waveform, the same display quality (the same density, for example) is obtained for any display pattern.

However, there is produced dullness in the voltage waveform applied to the liquid crystal device itself, due to the own load of the liquid crystal device, the wiring resistance, or the like. For this reason, the effective voltage applied to the liquid crystal device becomes different from the ideal voltage depending on display patterns, thus deteriorating the display quality.

SUMMARY

According to a first aspect of the invention, there is provided a power supply circuit which generates driving voltages for an electro-optic device having a plurality of common electrodes and a plurality of segment electrodes with the use of a multi-line driving in which four lines of common electrodes are simultaneously selected, the driving voltages being first through seventh driving voltages in which an i-th ($2 \leqq i \leqq 5$, and i is an integer) driving voltage is higher than an (i+1)th driving voltage, the power supply circuit comprising:

a common electrode driving-voltage generator circuit which generates the first and seventh driving voltages used for selection of the common electrodes at a positive side and a negative side on the basis of the fourth driving voltage; and a segment electrode driving-voltage generator circuit which generates the fourth driving voltage, the second and third driving voltages used for the segment electrodes at the positive side on the basis of the fourth driving voltage, and the fifth and the sixth driving voltages used for the segment electrodes at the negative side on the basis of the fourth driving voltage, wherein the segment electrode driving-voltage generator circuit changes and outputs output potentials of only the third and fifth driving voltages from among the second through sixth driving voltages, while a voltage difference between the third and fourth driving voltages is kept equal to a voltage difference between the fourth and the fifth driving voltages.

According to a second aspect of the invention, there is provided a driving device used for driving an electro-optic device having a plurality of common electrodes and a plurality of segment electrodes, the driving device comprising:

the above-described power supply circuit; and a driving section which drives at least ones of the common electrodes and the segment electrodes by using a driving voltage supplied from the power supply circuit.

According to a third aspect of the invention, there is provided an electro-optic device, comprising:

a plurality of common electrodes;

a plurality of segment electrodes; and the above-described driving device.

According to a fourth aspect of the invention, there is provided an electronic apparatus, comprising the above-described power supply circuit.

According to a fifth aspect of the invention, there is provided a method of supplying driving voltages that supplies driving voltages for an electro-optic device having a plurality of common electrodes and a plurality of segment electrodes with the use of multi-line driving in which four lines of the common electrodes are simultaneously selected, the driving voltages being first through seventh driving voltages in which an i-th ($2 \leqq i \leqq 5$, and i is an integer) driving voltage is higher than an (i+1)th driving voltage, the method of supplying driving voltages comprising:

supplying the first and seventh driving voltages used for selection of the common electrodes at a positive side and a negative side on the basis of the fourth driving voltage; and supplying the fourth driving voltage, the second and third driving voltages used for the segment electrodes at the positive side on the basis of the fourth driving voltage, and the fifth and sixth driving voltages used for the segment electrodes at the negative side on the basis of the fourth driving voltage, wherein output potentials of only the third and fifth driving voltages from among the second through sixth driving voltages are changed and outputted, while a voltage difference between the third and fourth driving voltages is kept equal to a voltage difference between the fourth and the fifth driving voltages.

BRIEF DESCRIPTION OF THE SEVERAL VIEWS OF THE DRAWING

FIG. 4A and FIG. 4B are views showing one ex ample of the scanning pattern in the MLS driving method of simultaneously selecting four lines of common electrodes.

FIGS. 9A to 9G are views showing a combination of driving voltages in the MLS driving method of simultaneously selecting four lines of common electrodes.

DETAILED DESCRIPTION OF THE EMBODIMENTS

Figure 1:
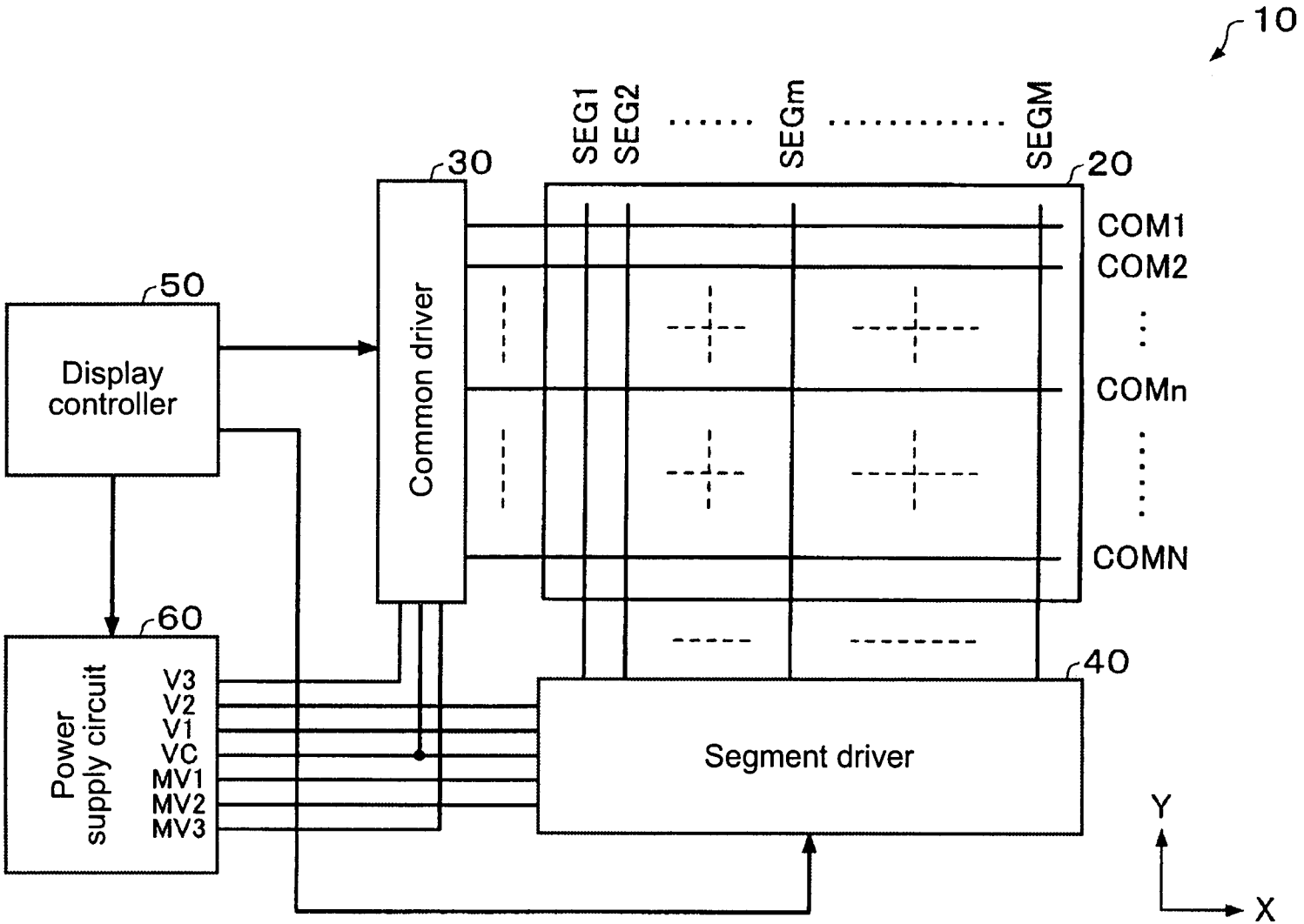
FIG. 1 is a block diagram of a configuration example of a display device including an electro-optic device according to an embodiment.

An advantage of the invention is to provide a power supply circuit, a driving device, an electro-optic device, an electronic apparatus, and a method of supplying driving voltages, which prevent the deterioration of display quality in the MLS driving method.

According to one embodiment of the invention, a power supply circuit generates driving voltages for an electro-optic device having a plurality of common electrodes and a plurality of segment electrodes with the use of a multi-line driving in which four lines of common electrodes are simultaneously selected, the driving voltages being first through seventh driving voltages (V3, V2, V1, VC, MV1, MV2, MV3) in which an i-th ($2 \leqq i \leqq 5$, and i is an integer) driving voltage is higher than an (i+1)th driving voltage. The power supply circuit includes: a common electrode driving-voltage generator circuit for generating the first and seventh driving voltages (V3, MV3) used for selection of the common electrodes at a positive side and a negative side on the basis of the fourth driving voltage (VC); and a segment electrode driving-voltage generator circuit for generating the fourth driving voltage (VC), second and third driving voltages (V2, V1) used for the segment electrodes at the positive side on the basis of the fourth driving voltage (VC), and the fifth and the sixth driving voltages (MV1, MV2) used for the segment electrodes at the negative side on the basis of the fourth driving voltage (VC). The segment electrode driving-voltage generator circuit changes and outputs output potentials of only the third and fifth driving voltages (V1, MV1) from among the second through sixth driving voltages, while a voltage difference between the third and fourth driving voltages (V1, VC) is kept equal to a voltage difference between the fourth and the fifth driving voltages (VC, MV1).

In this embodiment, paying attention to the fact that there are two patterns of driving voltages for the segment electrode in the MLS driving method of simultaneously selecting four lines of common electrodes, the effective voltage of a pixel in one frame period is caused to change the output potentials of only the third and fifth driving voltages from among the second through sixth driving voltages. By doing this way, even if the third and fifth driving voltages are adjusted when adjusting the effective voltage of the pixel in one frame period, there will be no influences on the effective voltage of the pixel of the pattern to which the second, fourth, and sixth driving voltages are applied. For this reason, there will be produced no differences in the actual effective voltage applied to the liquid crystal device depending on the display patterns, and it is possible to avoid the situation where the density will differ, for example, even for the same white display, thereby deteriorating the display quality. Moreover, the effective voltage can be adjusted with a minimum addition of circuitry.

In this power supply circuit, it is preferable that the first driving voltage (V3) be higher than the second driving voltage (V2), the sixth driving voltage (MV2) be higher than the seventh driving voltage (MV3), and the second through fifth driving voltages (V2, V1, VC, MV1, MV2) be generated based on divided voltages made by dividing a voltage difference between the first and seventh driving voltages (V3, MV3).

Moreover, it is preferable that the power supply circuit according to this embodiment further include a voltage divider circuit which divides a voltage difference between the first and seventh driving voltages (V3, MV3) into first through third divided voltages and outputs the first through third divided voltages (DV1, DV3). The segment electrode driving-voltage generator circuit may include: a first impedance converter circuit having an input to which the first divided voltage is supplied, the second driving voltage (VC) being outputted from the first impedance converter circuit; a second impedance converter circuit having an input to which the second divided voltage is supplied, the fourth driving voltage (VC) being outputted from the second impedance converter circuit; a third impedance converter circuit having an input to which the third divided voltage is supplied, the sixth driving voltage (MV2) being outputted from the third impedance converter circuit; a first selector circuit which is used to select of divided voltages which are lower than the first divided voltage (DV1) and higher than the second divided voltage (DV2); a fourth impedance converter circuit having an input to which an output of the first selector circuit is supplied, the third driving voltage (V1) being outputted from the fourth impedance converter circuit; a second selector circuit which is used to select one of divided voltages which are lower than the second divided voltage (DV2) and higher than the third divided voltage (DV3); and a fifth impedance converter circuit having an input to which an output of the second selector circuit is supplied, the fifth driving voltage (MV1) being outputted from the fifth impedance converter circuit.

Moreover, in the power supply circuit according to this embodiment, it is preferable that when the voltage difference between the third and fourth driving voltages (V1, VC) is denoted by Adif, a voltage difference between the second and third driving voltages (V2, V1) by Bdif, the voltage difference between the fourth and fifth driving voltages (VC, MV1) by Adif, and a voltage difference between the fifth and sixth driving voltages (MV1, MV2) by Bdif, the segment electrode driving-voltage generator circuit change the output potentials of the third and fifth driving voltages (V1, MV1) so that Adif becomes larger than Bdif, when an effective voltage Arms of a pixel intersecting with one of the segment electrodes driven by one of the second, fourth, and sixth driving voltages (V2, VC, MV2) is larger than an effective voltage Brms of a pixel intersecting with one of the segment electrodes driven by one of the third and fifth driving voltages (V1, MV1), and change the output potentials of the third and fifth driving voltages (V1, MV1) so that Adif becomes smaller than Bdif, when Arms is smaller than Brms.

Moreover, according to one embodiment of the invention, there is provided a driving device used for driving an electro-optic device having a plurality of common electrodes and a plurality of segment electrodes, the driving device including: the above-described power supply circuit; and a driving section which drives at least ones of the common electrodes and the segment electrodes by using a driving voltage supplied from the power supply circuit.

According to this embodiment, a driving device that prevents deterioration of the display quality in the MLS driving method may be provided.

Moreover, according to one embodiment of the invention, there is provided an electro-optic device including a plurality of common electrodes, a plurality of segment electrodes, and the above-described driving device.

According to this embodiment, an electro-optic device that prevents deterioration of the display quality in the MLS driving method may be provided.

According to one embodiment of the invention, there is provided an electronic apparatus including the above-described power supply circuit.

According to this embodiment, an electronic apparatus including a power supply circuit that prevents deterioration of the display quality in the MLS driving method may be provided.

According to one embodiment of the invention, there is provided a method of supplying driving voltages that supplies driving voltages for driving an electro-optic device having a plurality of common electrodes and a plurality of segment electrodes with the use of multi-line driving in which four lines of common electrodes are simultaneously selected, the driving voltages being first through seventh driving voltages (V3, V2, V1, VC, MV1, MV2, MV3) in which an i-th ($2 \leqq i \leqq 5$, and i is an integer) driving voltage is higher than an (i+1)th driving voltage, the method of supplying driving voltages including: supplying the first and seventh driving voltages (V3, MV3) used for selection of common electrodes at a positive side and a negative side on the basis of the fourth driving voltage (VC); and supplying the fourth driving voltage, the second and third driving voltages (V2, V1) used for the segment electrodes at the positive side on the basis of the fourth driving voltage (VC), and the fifth and sixth driving voltages (MV1, MV2) used for the segment electrodes at the negative side on the basis of the fourth driving voltage (VC), wherein output potentials of only the third and fifth driving voltages (V1, VM1) from among the second through sixth driving voltages are changed and outputted, while a voltage difference between the third and fourth driving voltages (V1, VC) is kept equal to a voltage difference between the fourth and the fifth driving voltages (VC, MV1).

Moreover, in this method of supplying driving voltages, it is preferable that when the voltage difference between the third and fourth driving voltages (V1, VC) is denoted by Adif, a voltage difference between the second and third driving voltages (V2, V1) by Bdif, the voltage difference between the fourth and fifth driving voltages (VC, MV1) by Adif, and a voltage difference between the fifth and sixth driving voltages (MV1, MV2) by Bdif, the output potential of the third and fifth driving voltages (V1, MV1) are changed so that Adif becomes larger than Bdif, when an effective voltage Arms of a pixel intersecting with one of the segment electrodes driven by one of the second, fourth, and sixth driving voltages (V2, VC, MV2) is larger than an effective voltage Brms of a pixel intersecting with one of the segment electrodes driven by one of the third and fifth driving voltages (V1, MV1), and the output potentials of the third and fifth driving voltages (V1, MV1) are changed so that Adif becomes smaller than Bdif, when Arms is smaller than Brms.

These embodiments of the invention will now be described in detail using accompanying drawings. In addition, the embodiments described hereinafter do not unduly restrict the contents of the invention described in claims. Moreover, all of the configurations to be described hereinafter are not necessarily indispensable configuration requirements of the invention.

1. Electro-optic Device

FIG. 1 shows a block diagram of a configuration example of a display device including an electro-optic device in the embodiment. In FIG. 1, a liquid crystal device 10 is shown as the display device.

This liquid crystal device 10 includes a simple-matrix type liquid crystal panel 20 as the electro-optic device. A liquid crystal panel 20 includes a plurality of common electrodes (scanning electrodes, in a broad sense) COM1 through COMN (N is an integer not less than 2), and a plurality of segment electrodes (signal electrodes, in a broad sense) SEG1 through SEGM (M is an integer not less than 2). Further, the liquid crystal device 10 may include a common driver (a scanning electrode driver circuit: a driving device in a broad sense) 30 for driving the common electrodes COM 1 through COMN, and a segment driver (a signal-electrode driver circuit, a driving device in a broad sense) 40 for driving the segment electrodes SEG1 through SEGM.

In the liquid crystal panel 20, a pixel having a liquid crystal (an electro-optic material in a broad sense) sandwiched at the intersecting region of a common electrode and a segment electrode is provided. Each pixel is identified by the common electrode and the segment electrode.

More specifically, in the liquid crystal panel 20, a liquid crystal is enclosed in between a first substrate in which the common electrodes COM 1 through COMN are formed, and a second substrate in which the segment electrodes SEG1 through SEGM are formed. In the first substrate, a plurality of common electrodes COM1 through COMN, each of the common electrodes being extending in the X-direction, are arranged in the Y-direction. In the second substrate, a plurality of segment electrodes SEG1 through SEGM, each of the segment electrodes being extending in the Y-direction, are arranged in the X-direction. Then, a common driver 30 selects any one of the common electrodes COM 1 through COMN, and applies a predetermined selection voltage (V3 or MV3) to the selected common electrode. Moreover, the common driver 30 applies a predetermined non-selection voltage (VC) to non-selection common electrodes. The segment driver 40 applies to the segment electrodes SEG1 through SEGM the driving voltages corresponding to a scanning pattern of the common electrode and a display pattern of pixels which have been selected simultaneously.

Moreover, the liquid crystal device 10 may include a display controller 50. This display controller 50 provides the segment driver 40 with the display data for designating the above-described display pattern. Moreover, the display controller 50 designates the display timing of the common driver 30 and segment driver 40, and carries out a control for realizing the MLS driving method of simultaneously selecting four lines of common electrode. Further, the display controller 50 controls a power supply circuit 60, and can carry out a control of increasing and decreasing of the potentials of the voltages V1 and MV1 from among seven levels of voltages for the above-described MLS driving method.

Further, the liquid crystal device 10 includes the power supply circuit 60. This power supply circuit 60 generates a plurality of driving voltages (V3, V2, V1, VC, MV1, MV2, MV3) with respect to the common electrodes COM1 through COMN and segment electrodes SEG1 through SEGM. The voltages V3 (the first driving voltage), VC (the fourth driving voltage), and MV3 (the seventh driving voltage) are provided to the common driver 30. The voltages V2 (the second driving voltage), V1 (the third driving voltage), VC (the fourth driving voltage), MV1 (the fifth driving voltage), and MV2 (the sixth driving voltage) are provided to the segment driver 40.

In the MLS driving method of simultaneously selecting four lines of common electrode, the driving voltage for the segment electrode is identified by the results of the MLS operation using orthogonal functions corresponding to the scanning pattern (the selection pattern, voltage pattern) of the four lines of common electrodes to be selected simultaneously.

In addition, the liquid crystal panel 20 may be formed in a glass substrate, and further at least one of the common driver 30 and the segment driver 40 may be formed in this glass substrate. Further, at least one of the display controller 50 and the power supply circuit 60 may be also formed in the glass substrate in which at least one of the common driver 30 and the segment driver 40 is formed.

Moreover, the power supply circuit 60 of FIG. 1 may be incorporated in the common driver 30 or the segment driver 40. In this case, one driver incorporating the power supply circuit 60 provides driving voltages to the other driver.

2. MLS Driving Method 2.1 Principles of MLS Driving Method

First, the MLS driving method will be described.

In the MLS driving method, the selection voltage (the driving voltage) of the common voltage can be reduced by selecting a plurality of common electrodes simultaneously. Then, as compared with the so-called line sequential driving method, the interval of the selection period of the common electrode can be made narrower, and thereby deterioration of transmissivity of the liquid crystal panel can be suppressed to improve the average transmissivity.

FIGS. 2A to 2D show a view explaining the principles of the MLS driving method.

FIGS. 2A to 2D show a case where two lines of common electrodes COM1 and COM2 are selected simultaneously, and the pixels in the positions where the common electrodes COM1, COM2 and the segment electrode SEG1 intersect with each other are turned on or off. In addition, in FIGS. 2A to 2D, a pixel to be turned on (a turned-on pixel) is expressed as "−1", a pixel to be turned off (a turned-off pixel) is expressed as "+1", and the pixels are designated by this display data indicative of the turned on or off. Moreover, the selection pulse for selecting the common electrode is expressed with a binary of "+1" and "−1". Further, the driving voltage for the segment electrode SEG1 has a ternary of "MV2", "V2", and "V1".

Which voltage out of "MV2", "V2", and "V1" to set to the driving voltage for the segment electrode SEG1 is determined by the product of a display-data vector d and a selection matrix β. The display-data vector d is expressed in a vector of the data indicating the turned on or off of the pixel in the position where the segment electrode SEG1 intersects with each common electrode. The selection matrix β is expressed in a matrix of the selection pulse for selecting each common electrode with which the segment electrode SEG1 intersects.

Figures 2A, 2B, 2C, 2D:
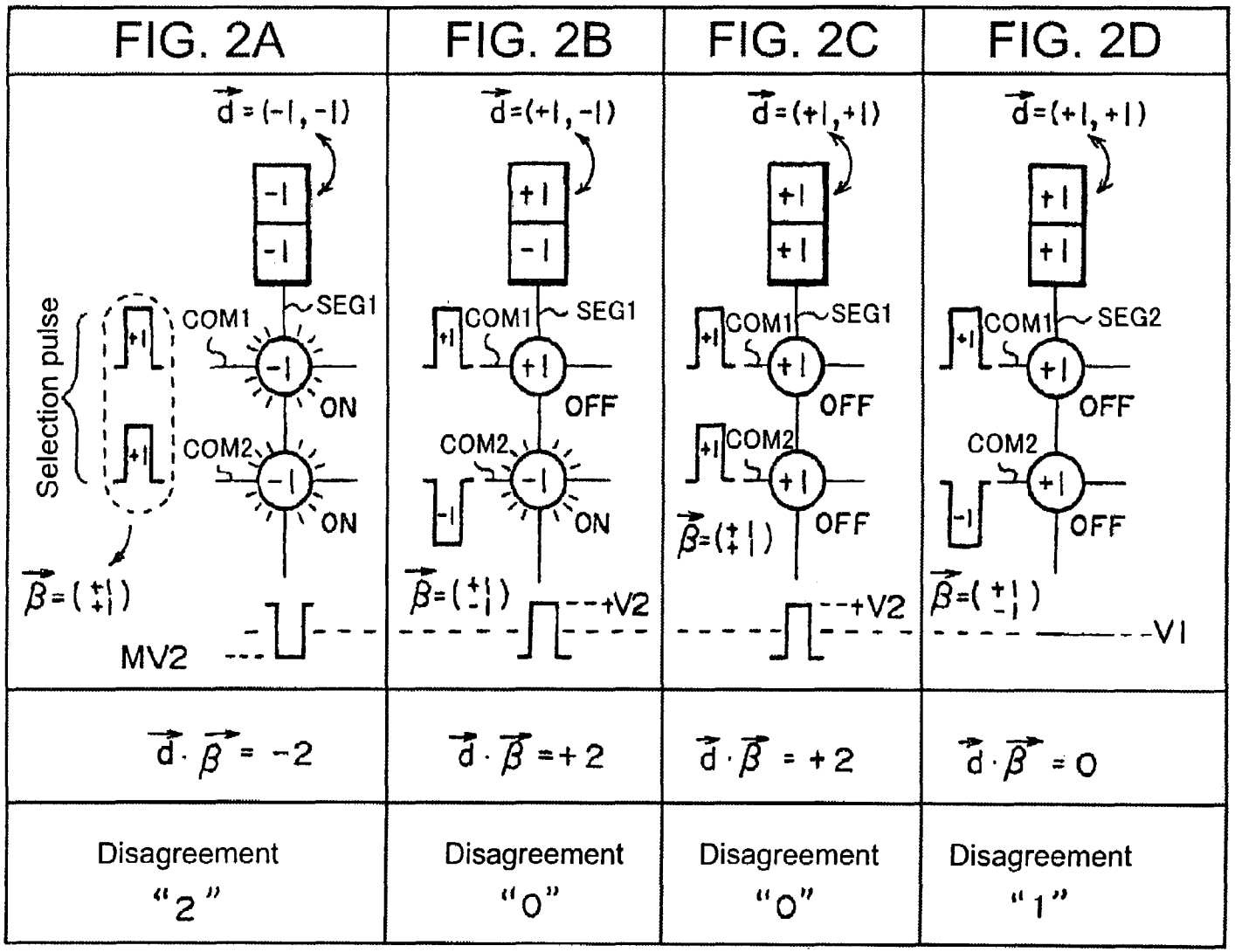
FIGS. 2A to 2D are views explaining the principles of MLS driving method.

In the case of FIG. 2A, $d \cdot \beta = -2$; in the case of FIG. 2B, $d \cdot \beta = +2$; in the case of FIG. 2C, $d \cdot \beta = +2$; and in the case of FIG. 2D, $d \cdot \beta = 0$.

Then, when the product of the display-data vector d and the selection matrix β is "−2", "MV2" is selected as the driving voltage for the segment electrode SEG1, and when it is "+2", "V2" is selected, and when it is "0", "V1" is selected.

For example, in the case where operation of the product of the display-data vector d and the selection matrix β is carried out with hardware, the number of disagreement between each component data of the display-data vector d, and each component data of the selection matrix β just needs to be determined.

For example, if the number of disagreement is "2", "MV2" is selected as the driving voltage for the segment electrode SEG1. Moreover, if the number of disagreement is "0", "V2" is selected as this driving voltage. Moreover, if the number of disagreement is "1", "V1" is selected as this driving voltage.

In the MLS driving method of simultaneously selecting two lines of common electrodes, the turned on or off of pixels is controlled by determining the driving voltage for the segment electrode SEG1 as mentioned above, and providing two times of selection periods in one frame period. Because there are provided a plurality of selection periods, deterioration of the transmissivity in the non-selection period will be reduced, thereby improving the average transmissivity of the liquid crystal panel, and thus the contrast of the liquid crystal panel can be improved.

Figure 3:
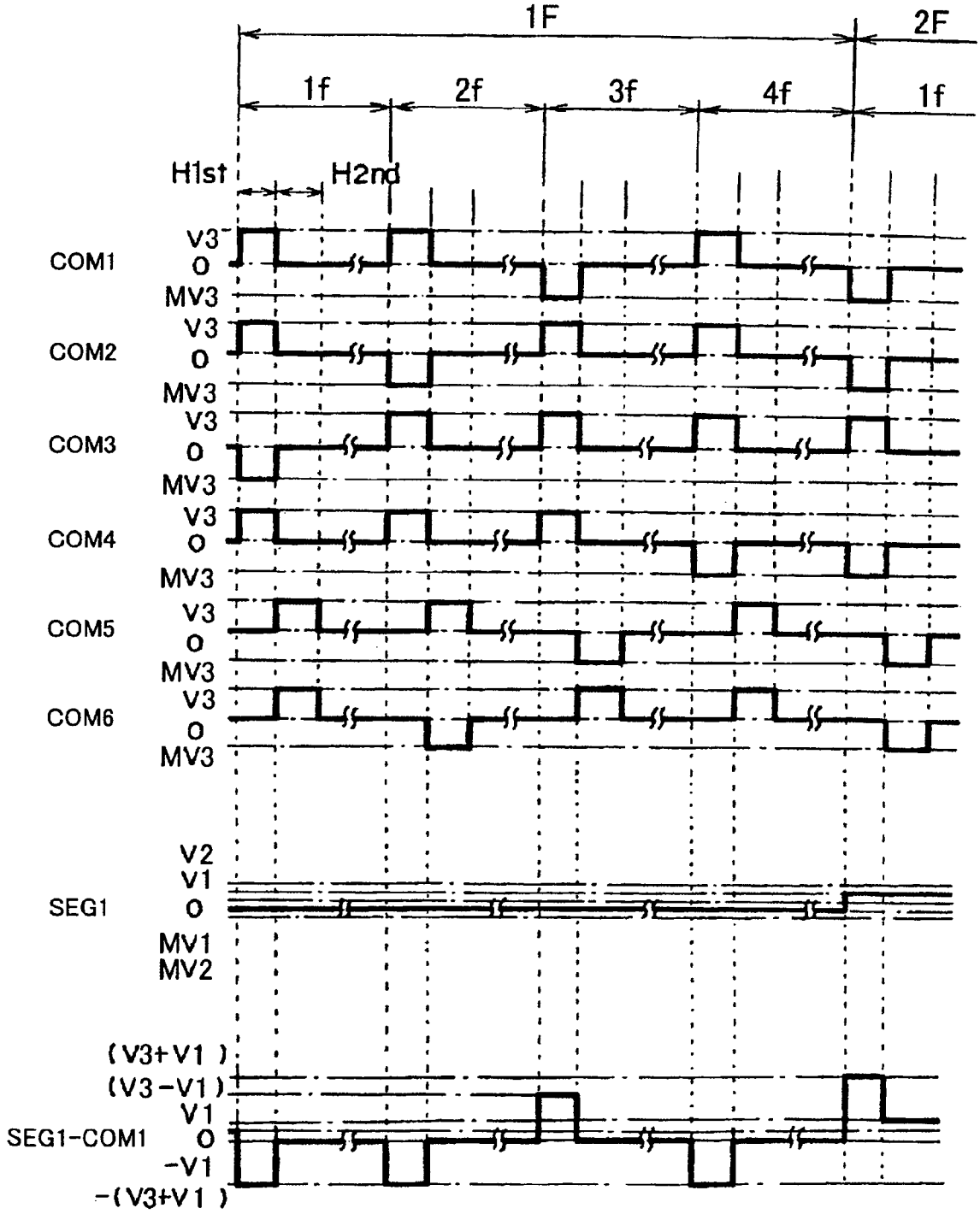
FIG. 3 is a view showing one example of waveform of driving voltages in the MLS driving method of simultaneously selecting four lines of common electrodes.

FIG. 3 shows one example of a waveform of the driving voltages in the MLS driving method of simultaneously selecting four lines of common electrodes.

Three voltages (V3, 0, MV3) are selected suitably for the common electrode in accordance with the scanning pattern defined by the system of orthogonal functions that are selected in advance. Then, they are applied to the common electrodes to be simultaneously selected, respectively.

FIG. 4A and FIG. 4B show one example of the scanning pattern in the MLS driving method of simultaneously selecting four lines of common electrodes.

In FIG. 4A and FIG. 4B, data of a scanning pattern for the common electrodes to be selected simultaneously is arranged in the column direction (the vertical direction), and the scanning pattern in each field made by dividing one frame period is arranged in the line direction (the lateral direction). In FIG. 3, in accordance with the scanning pattern of FIG. 4B, when the component data is "0", then the selection voltage "V3" is applied to the selected common electrode, and when the component data is "1", then the selection voltage "MV3" is applied to the selected common electrode.

Here, the scanning pattern is set to (+) when the selection voltage is "V3", and set to (−) when the selection voltage is "MV3", while the display pattern is set to (+) in the case of the turned-on display data, and set to (−) in the case of the turned-off display data. In the non-selection period, the number of disagreement is not taken into consideration.

In FIG. 3, a period required for displaying one screen is defined as one frame period (F), a period required for selecting all common electrodes once is defined as one field period (f), and a period required for selecting a common electrode once is defined as one common-selection period (H).

Here, "H1st" of FIG. 3 is the first common selection period, and "H2nd" is the second common selection period. Moreover, "1*f*" of FIG. 3 is the first field period, and "2*f*" is the second field period. Further, "1F" of FIG. 3 is the first frame period, and "2F" is the second frame period.

In the case of FIG. 3, the scanning pattern of four lines (COM1 through COM4) selected in the first common selection period H1st of the first field period 1*f* is set in advance as shown in FIG. 3, which is always (++−+) regardless of the conditions of the display screen.

Here, considering the case where a full-screen display is carried out, the display pattern of the first column corresponding to a pixel (COM1, SEG1), a pixel (COM2, SEG1), a pixel (COM3, SEG1), and a pixel (COM4, SEG1) is (++++). Comparing the both patterns one-by-one, the polarity is in agreement in the first one, the second one, and the fourth one, while the polarity differs in the third one. That is, the number of disagreement is "1". When the number of disagreement is "1", "MV2" is selected from among five levels of voltages (V2, V1, 0, MV1, MV2). If doing this way, in the case of the common electrodes COM1, COM2, and COM4 to which "V3" is being applied, the voltage applied to the liquid crystal device will increase because the "MV2" is selected as the driving voltage, and on the other hand, in the case of common electrodes COM3 in which "MV1" is selected as the driving voltage, the voltage applied to the liquid crystal device will decrease because "MV2" is selected as the driving voltage.

In this way, the voltage applied to the segment electrode corresponds to the "weight of a vector" in the orthogonal transformation, and if all the weights are added with respect to the four times of scanning patterns, the voltages will be set so that the true display pattern can be reproduced.

In the same way, if the number of disagreement is "0", then "MV2" is selected, and if the number of disagreement is "2", then a zero level is selected, and if the number of disagreement is "3", then "V1" is selected, and if the number of disagreement is "4", then "V2" is selected. The voltage ratio of V2 and V3 is set so as to be (V2: V3=1:2).

Through the same procedure, with respect to the four lines of common electrodes COM1 through COM4, the number of disagreement in the column of from the segment electrode SEG2 through SEGM is determined, and the data of the obtained selection voltage is transferred to the segment driver, and the voltage determined through the above-described procedure is applied in the first common-selection period.

In the same way, if the above procedure has been repeated with respect to all the common electrodes COM1 through COMN, the operation in the first field period (1*f*) will be completed.

In the same way, if the above-described procedure has been repeated with respect to all common electrodes also in the field periods of the second and thereafter, one frame period (1F) will be completed, and, thereby the display of one screen will be carried out.

In accordance with the above-described procedure, the voltage waveform applied to the segment electrode SEG1 in the case where the full-screen is turned on will be the one shown in FIG. 3, and the voltage waveform applied to the pixel (COM1, SEG1) will be the one shown in FIG. 3.

In addition, the voltage 0 level of the common electrode, and the driving voltage 0 level of the segment electrode in FIG. 3 are made in common, and the driving voltage VC is used as the center voltage. Then, if the voltage V3 is set in the positive side on the basis of the center voltage VC, the voltage MV3 serves as the selection voltage in the negative side. Moreover, if the voltage V2 is set in the positive side on the basis of the center voltage VC, the voltage MV2 serves as the driving voltage in the negative side. Further, if the voltage V1 is set in the positive side on the basis of the center voltage VC, the voltage MV1 serves as the driving voltage in the negative side.

2.2 Effective Voltage

As described above, in the MLS driving method, one frame period is divided into a plurality of fields, and all common electrodes are selected in each field period. Then, the voltage (the effective voltage) applied effectively to the liquid crystal device, with respect to the pixels of the same display pattern, in one frame period is mutually equal.

Figure 5:
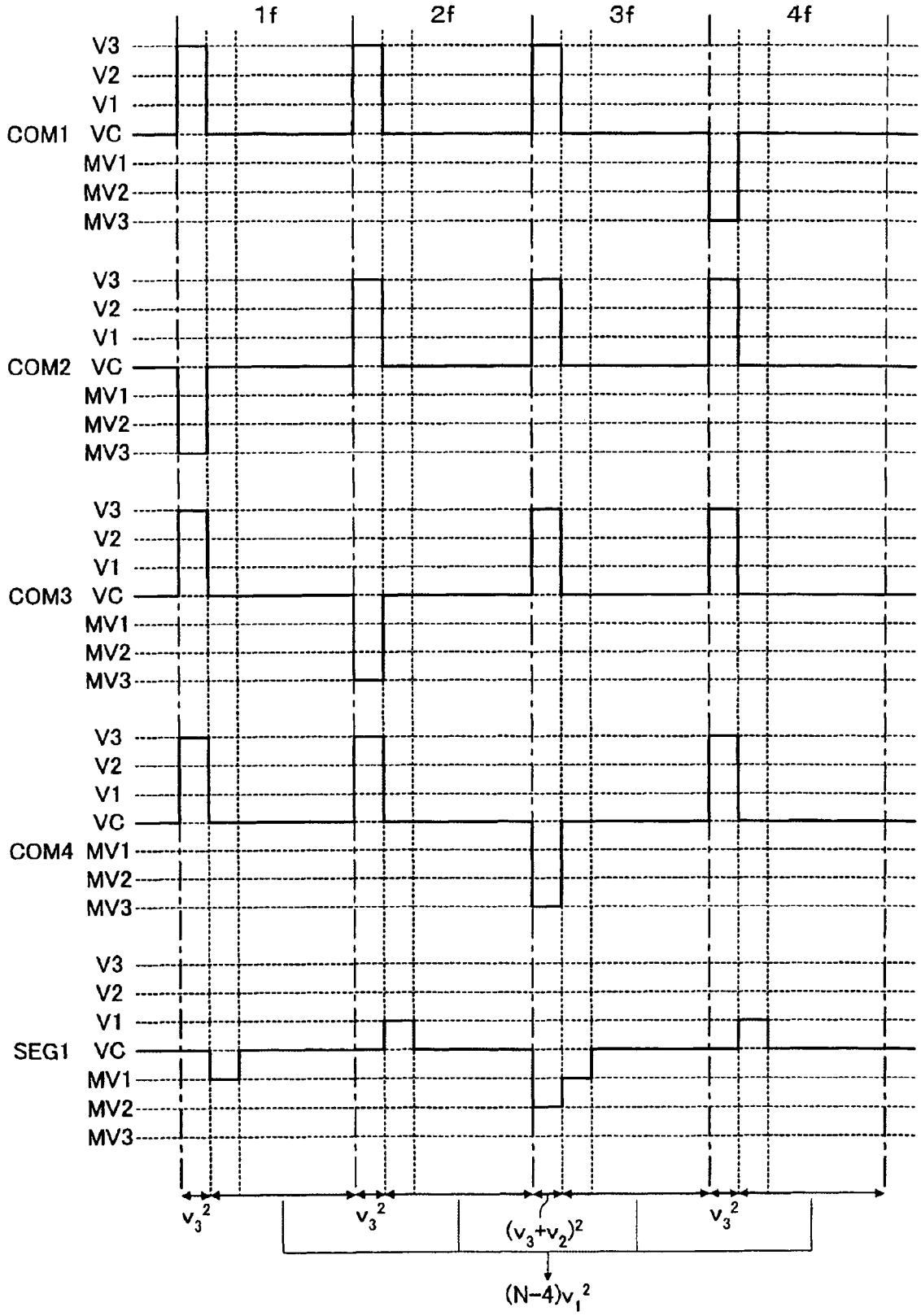
FIG. 5 is a view showing another example of waveform of driving voltages of a segment electrode for explaining an effective voltage.

In FIG. 5, there is shown another example of a waveform of the driving voltage of the segment electrode SEG1 for explaining the effective voltage. FIG. 5 shows a waveform example in the MLS driving method of simultaneously selecting four lines of common electrodes, wherein the pixel (COM1, SEG1) is turned on, the pixel (COM2, SEG1) is turned on, the pixel (COM3, SEG1) is turned on, and the pixel (COM4, SEG1) is turned off. Moreover, only eight lines of segment electrodes (two common-selection periods for each field) are shown, and the rest is omitted.

The effective voltage in one frame period can be expressed using the sum of the square of the voltage applied to the liquid crystal device in each selection period. Then, the effective voltage of the pixel (COM1, SEG1) to be turned on is expressed with the following equation (1).

$$V_{ON(RMS)} = \sqrt{\frac{3v_3^2 + (v_3 + v_2)^2 + (N-4)v_1^2}{N}} \quad (1)$$

Figure 18:
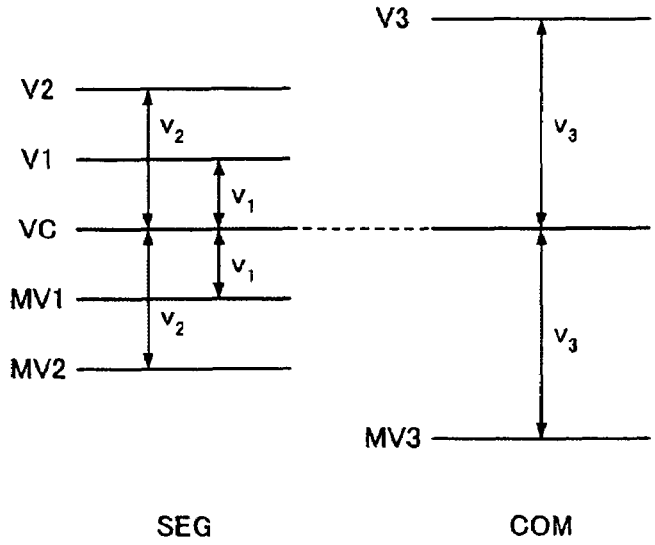
FIG. 18 is a view showing a relationship of seven levels of voltages when driving a simple-matrix type liquid crystal panel with the MLS driving method of simultaneously selecting four lines of common electrodes.

Here $v_3$, $v_2$, and $v_1$ are voltage differences shown in FIG. 18, and N is the number of lines of the common electrode.

There are four times of selection periods when the selection voltages V3 and MV3 are applied to the common electrode COM 1 in one frame period, and once out of the four times, the driving voltage MV2 is being applied to the segment electrode SEG1 in 3*f*. The term to which this portion contributes with respect to the equation (1), corresponds to the first and second terms of the numerator in the root of the equation (1).

The term to which the period when the voltage V1 or MV1 is being applied to the segment electrode SEG1, out of the remaining non-selection period when the driving voltage VC is applied to the common electrode COM 1 as the non-selection voltage, contributes with respect to the equation (1), corresponds to the third term of the numerator in the root of the equation (1).

As shown in FIG. 5, it is apparent that the effective voltage $V_{ON\ (RMS)}$ of the pixel (COM1, SEG1) shown in the equation (1) is the same as that of the other pixels (COM2, SEG1) and (COM3, SEG1) to be turned on.

On the other hand, the effective voltage $V_{OFF\ (RMS)}$ of the turned-off pixel (COM4, SEG1) in one frame period can be expressed as follows.

$$V_{OFF(RMS)} = \sqrt{\frac{3v_3^2 + (v_3 - v_2)^2 + (N-4)v_1^2}{N}} \tag{2}$$

Comparing the equation (1) with the equation (2), the effective voltages $V_{ON\ (RMS)}$ and $V_{OFF\ (RMS)}$ differ in the second term of the numerator in the root.

Figure 6:
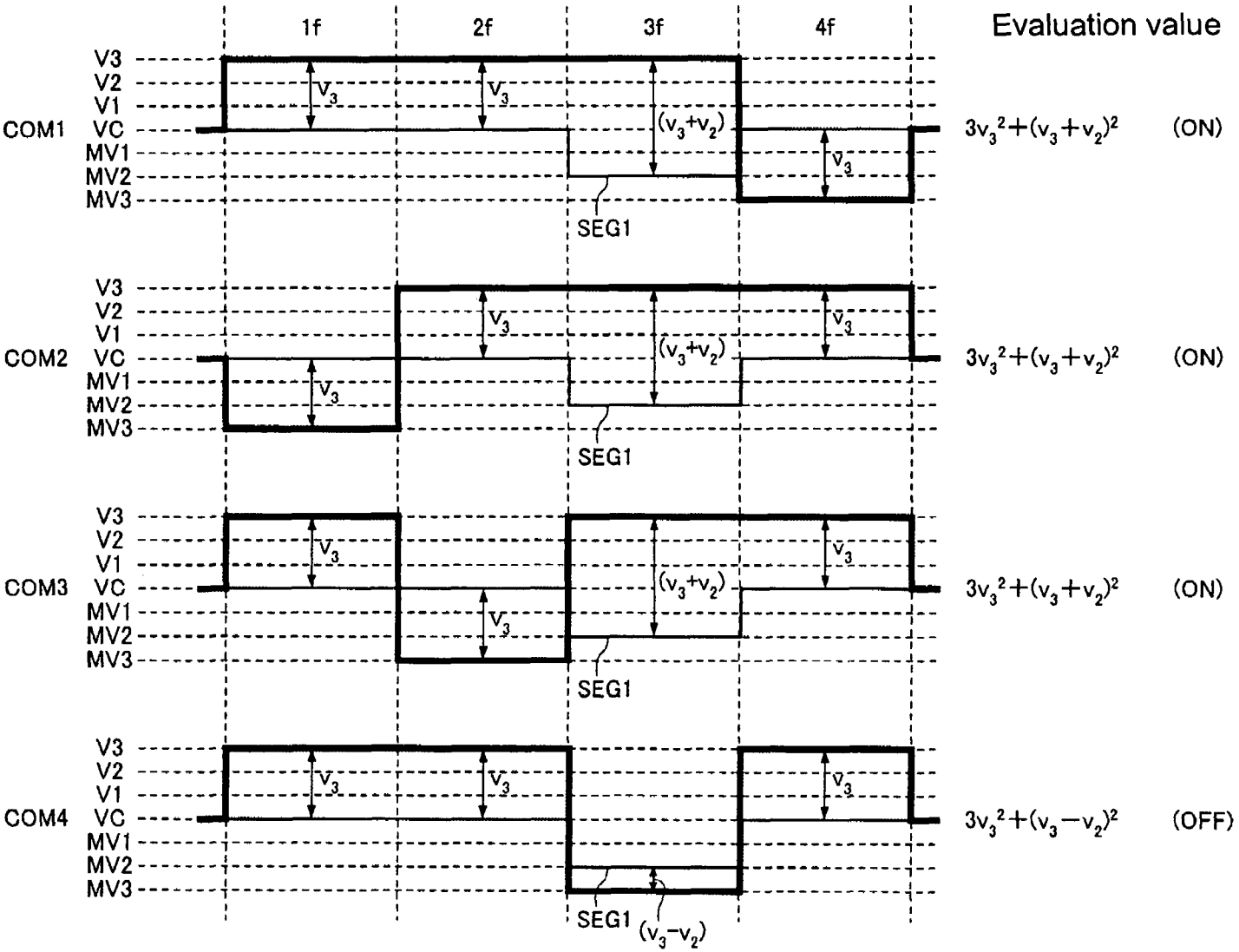
FIG. 6 is a view showing a driving waveform omitting a non-selection period in the segment electrode of FIG. 5.

FIG. 6 shows a driving waveform wherein the non-selection period is omitted in the segment electrode SEG1 of FIG. 5. Here, the first and second terms of the numerator in the root of the equations (1) and (2) are the evaluation values.

All the evaluation values of the pixels (COM1, SEG1), (COM2, SEG1), and (COM3, SEG1) to be turned on are equal. Then, the evaluation value of these pixels to be turned on is larger than the evaluation value of the pixel (COM4, SEG1) to be turned off.

Figure 7:
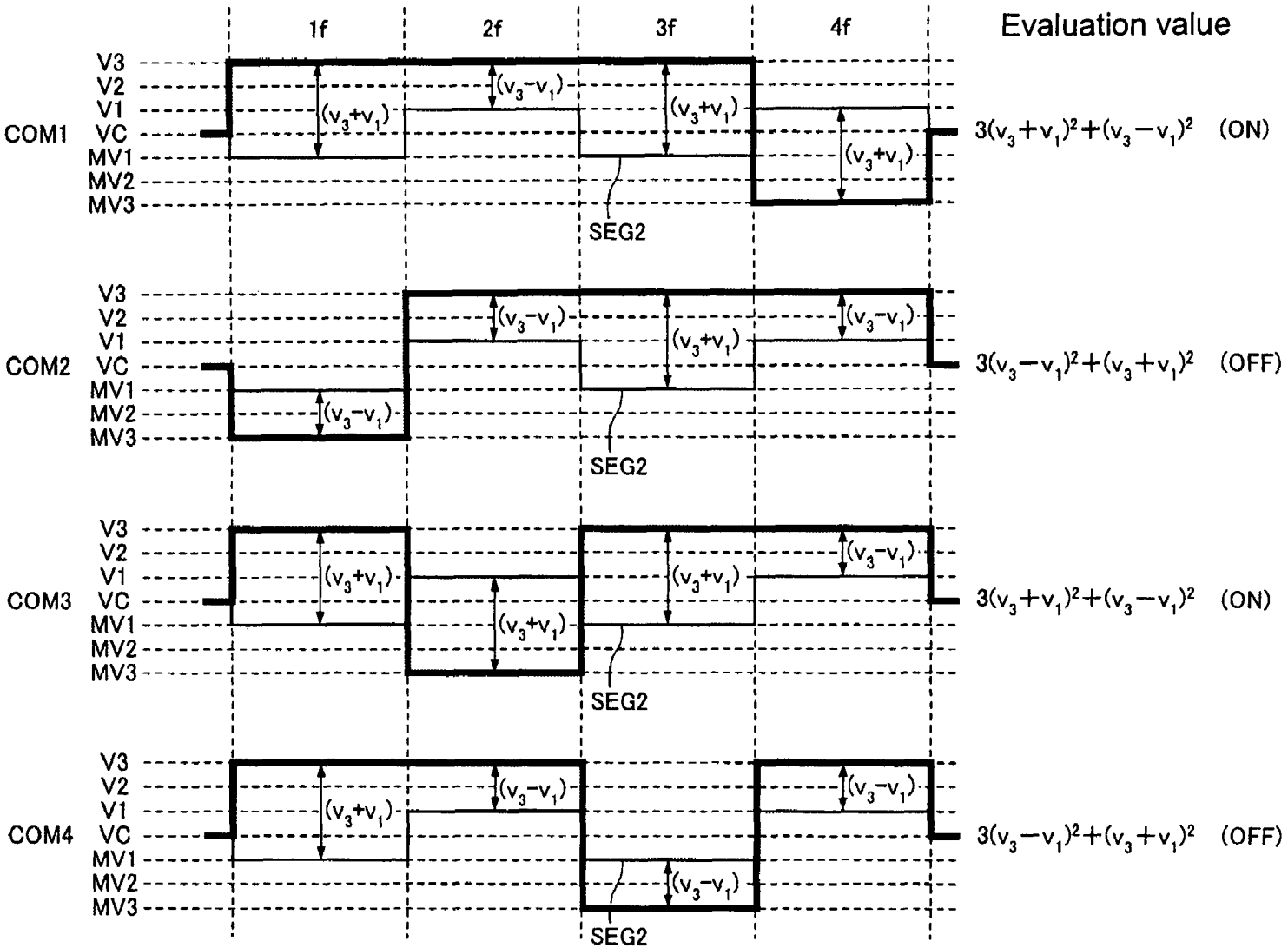
FIG. 7 is a view showing a driving waveform omitting the non-selection period in another segment electrode.

FIG. 7 shows a driving waveform in the segment electrode SEG2 like the one of FIG. 6.

FIG. 7 shows a waveform example in the MLS driving method of simultaneously selecting four lines of common electrodes, wherein the pixel (COM1, SEG2) is turned on, the pixel (COM2, SEG2) is turned off, the pixel (COM3, SEG2) is turned on, and the pixel (COM4, SEG2) is turned off.

The effective voltages $V_{ON\ (RMS)}$ of the pixels (COM1, SEG2) and (COM3, SEG2) to be turned on are mutually equal, and can be expressed as the following equation (3).

$$V_{ON(RMS)} = \sqrt{\frac{3(v_3 + v_1)^2 + (v_3 - v_1)^2 + (N-4)v_1^2}{N}} \tag{3}$$

Paying attention to the evaluation values which are the first and second terms in the root of the equation (3), the first and second terms can be modified as follows.

$$3(v_3+v_1)^2+(v_3-v_1)^2 = \ldots = 3v_3^2+(v_3+2v_1)^2 \tag{4}$$

The equation (4) needs to be equal to the evaluation value of the pixel (COM1, SEG1), pixel (COM2, SEG1), and pixel (COM3, SEG1) to be turned on in FIG. 6.

In the same way, the effective voltages $V_{OFF\ (RMS)}$ of the pixel (COM2, SEG2) and pixel (COM4, SEG2) to be turned off are mutually equal, and can be expressed as the following equation (5).

$$V_{OFF(RMS)} = \sqrt{\frac{3(v_3 - v_1)^2 + (v_3 + v_1)^2 + (N-4)v_1^2}{N}} \tag{5}$$

Paying attention to the evaluation values which are the first and second terms in the root of the equation (5), the first and second terms can be modified as follows.

$$3(v_3-v_1)^2+(v_3+v_1)^2 = \ldots = 3v_3^2+(v_3-2v_1)^2 \tag{6}$$

The equation (6) needs to be equal to the evaluation value of the pixel (COM4, SEG1) to be turned off in FIG. 6.

Consequently, the evaluation value of the turned-on pixels and the evaluation value of the turned-off pixels can be made equal, respectively, by having the relationship of the following equation (7). Namely, the evaluation value of the turned-on pixels and the evaluation value of the turned-off pixels can be made equal, respectively, by making the voltage difference between the voltage V2 and the voltage V1 (=the voltage difference between the voltage MV1 and the voltage MV2) equal to the voltage difference between the voltage V1 and the center voltage VC (=the voltage difference between the center voltage VC and the voltage MV1).

$$2v_1 = v_2 \tag{7}$$

Figure 8:
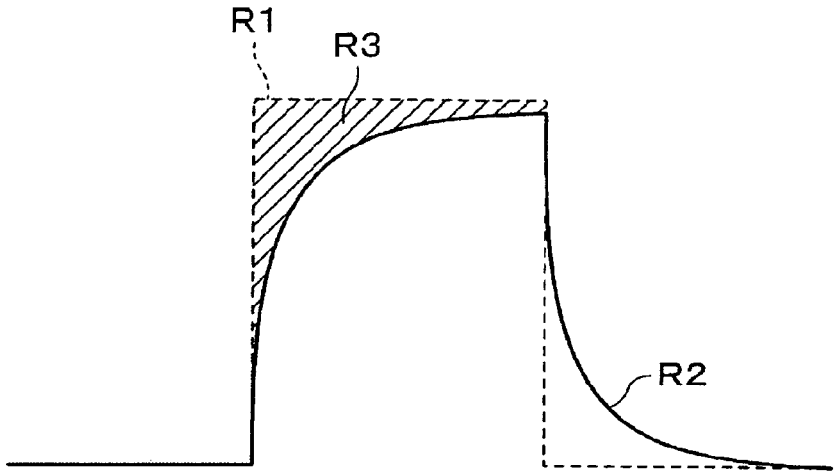
FIG. 8 is a view showing a relationship between the ideal waveform and the actual waveform of the driving voltage.

The above-described matters are valid if the selection voltage of the common electrode and the driving voltage of the segment electrode have the ideal waveform R1 as shown in FIG. 8. However, actually, there will be produced dullness like a waveform R2 in FIG. 8 because of the liquid crystal device itself having a capacitive load, or the wiring resistance of the segment electrode. Accordingly, because a wavy line portion R3 of FIG. 8 is not taken into account with respect to the above-described effective voltage, there will be produced differences in the actual effective voltages applied to the liquid crystal device depending on the display pattern, and for example, the density will differ even for the same white display, thereby deteriorating the display quality.

Therefore, it is desirable that the output potential of the driving voltage (including the selection voltage) for driving with the MLS driving method of simultaneously selecting four lines of common electrodes can be adjusted.

Incidentally, this adjustment can be ultimately realized in the above-described MLS driving method by combining the driving voltages and driving the segment electrode in each field period of one frame period as shown in FIGS. 9A to 9G. For example, in the case of FIG. 9A, one time of the driving voltage V2 and three times of the driving voltage VC just need to be applied in one frame period, and for example, in the case of FIG. 9E, two times of the driving voltage V1 and two times of the driving voltage MV1 just need to be applied in one frame period. Namely, if any one of the seven patterns of FIG. 9A to 9G is selected according to the number of disagreement between the scanning pattern of the common electrode and the display pattern of the pixel, the above-described MLS driving method can be realized.

Then, as shown in FIGS. 9A to 9G, it is apparent that the patterns can be differentiated into the pattern using the driving voltages V2, VC, and MV2, and the pattern using the driving voltages V1 and MV1. This means that in the pattern to be selected according to the number of disagreement between the scanning pattern of the common electrode and the display pattern of the pixel, the driving voltages V2, VC, and MV2 are not used mixing with the driving voltages V1 and MV1 in one frame period. Therefore, as for the effective voltage of the pixel in one frame period, there are patterns determined by the driving voltages V2, VC, and MV2, and patterns determined by the driving voltages V1 and MV1. Then, in adjusting the effective voltage of the pixel in one frame period, even if the driving voltages V1 and MV1 are adjusted, there will be no influences on the effective voltage of the pixel to which the driving voltages V2, VC, and MV2 are applied.

Then, in the embodiment, from among the driving voltages (including the selection voltages) for driving with the MLS driving method of simultaneously selecting four lines of common electrodes, only the output potentials of the driving voltages V1 and MV1 can be adjusted. By doing this way, it is possible to adjust the actual effective voltage and improve the display quality with a minimum addition of circuitry.

3. Power Supply Circuit

Figure 10:
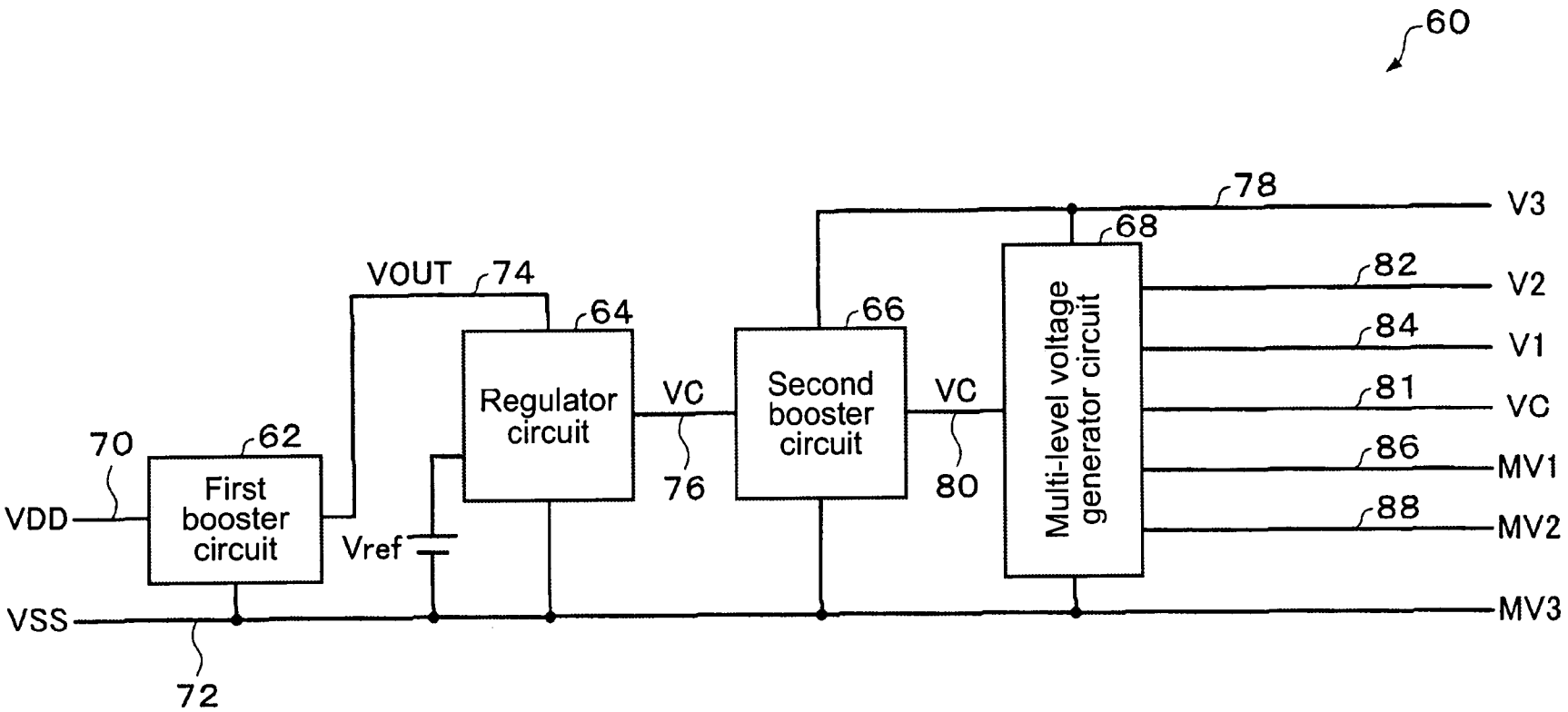
FIG. 10 is a block diagram of a configuration example of the power supply circuit of FIG. 1.

FIG. 10 shows a block diagram of a configuration example of the power supply circuit 60 of FIG. 1.

Figure 11:
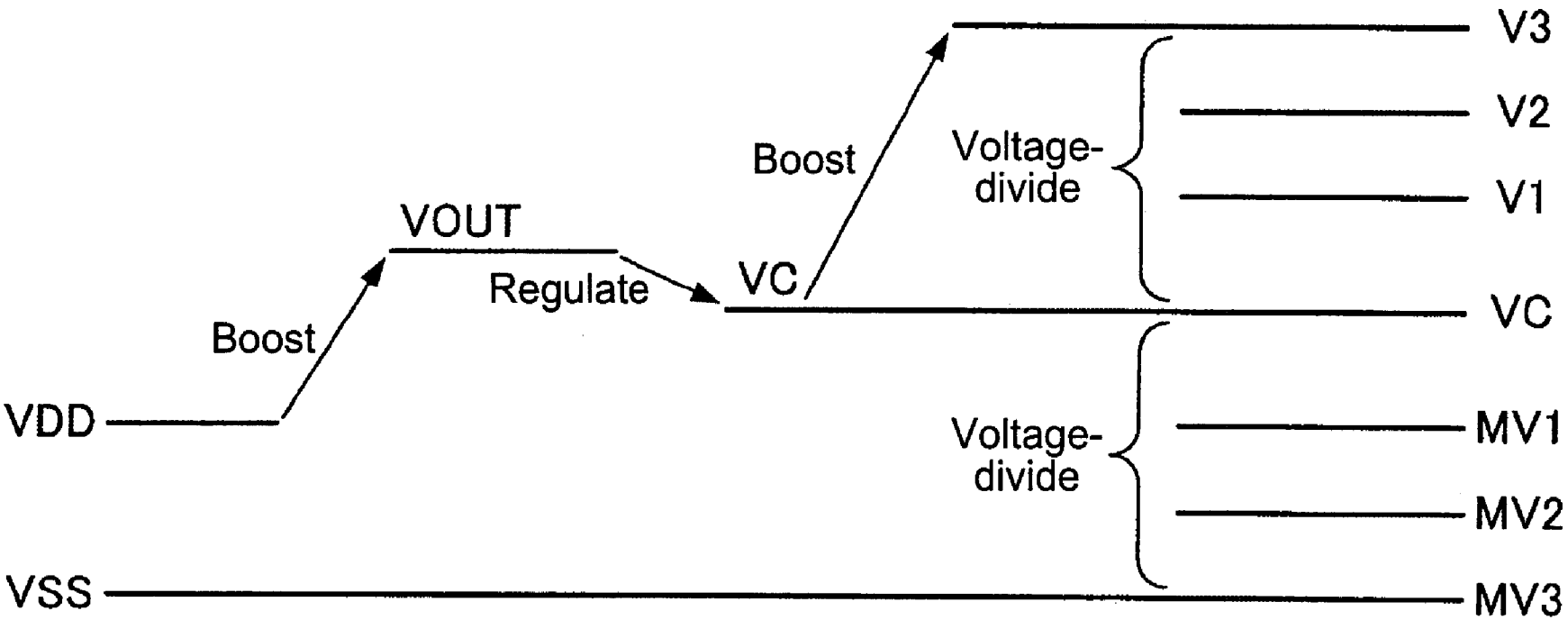
FIG. 11 is a schematic view for explaining operation of the power supply circuit of FIG. 10.

FIG. 11 shows a schematic view for explaining operation of the power supply circuit 60 of FIG. 10.

The power supply circuit 60 includes a first booster circuit 62, a regulator circuit 64 as a potential adjustment means, a second booster circuit 66, and a multi-level voltage generator circuit 68.

The first booster circuit 62 is coupled with a system power voltage supply line 70 to which a system power voltage VDD is supplied, a system power ground voltage supply line 72 to which a system power ground voltage VSS is supplied, and a first voltage supply line 74. The first booster circuit 62 supplies to the first voltage supply line 74 a first boost voltage VOUT, which is made by boosting the system power voltage VDD on the basis of the system power ground voltage VSS. Such first booster circuit 62 can be realized by the known charge pump circuit.

The regulator circuit 64 is coupled with the system power ground voltage supply line 72, the first voltage supply line 74, and a second voltage supply line 76. The regulator circuit 64 supplies to the second voltage supply line 76 the center voltage VC (the fourth driving voltage) made by adjusting the first boost voltage VOUT supplied from the first booster circuit 62 with reference to a reference voltage Vref on the basis of the system power ground voltage VSS. More specifically, the regulator circuit 64 generates, from the first boost voltage VOUT, the center voltage VC which is a constant voltage adjustable in potentials lower than the first boost voltage VOUT.

The second booster circuit 66 is coupled with the system power ground voltage supply line 72, the second voltage supply line 76, and a first driving voltage supply line 78. The second booster circuit 66 supplies to the first driving voltage supply line 78 the driving voltage V3 (the first driving voltage) made by boosting the center voltage VC that is adjusted by the regulator circuit 64 on the basis of the system power ground voltage VSS. Moreover, the second booster circuit 66 supplies the center voltage VC, as it is, to the multi-level voltage generator circuit 68, via a center voltage supply line 80.

The multi-level voltage generator circuit 68 is coupled with the system power ground voltage supply line 72, the center voltage supply lines 80 and 81, and the first through fifth driving voltage supply lines 78, 82, 84, 86, and 88. The multi-level voltage generator circuit 68 supplies the driving voltages V2 (the second driving voltage), V1 (the third driving voltage), MV1 (the fifth driving voltage), and MV2 (the sixth driving voltage), which are generated from the voltage difference between the driving voltage V3 supplied from the second booster circuit 66, and the center voltage VC on the basis of the system power ground voltage VSS, to the second through fifth driving voltage supply lines 82, 84, 86, and 88, respectively. Moreover, the center voltage VC, as it is, is outputted to the center voltage supply line 81, and the system power ground voltage VSS, as it is, is outputted as the driving voltage MV3 (the seventh driving voltage).

These driving voltages have the relationship of V2>V1>VC>MV1>MV2 in order to realize the MLS driving method. The multi-level voltage generator circuit 68 generates the driving voltages V2, V1, VC, MV1, and MV2 by dividing or down-converting the voltage difference between the driving voltage V3 and the center voltage VC, and the voltage difference between the center voltage VC and the system power ground voltage VSS, as shown in FIG. 10. As described above, the power supply circuit 60 can generate seven levels of driving voltages (V3, V2, V1, VC, MV1, MV2, MV3).

The driving voltages V3, VC, and MV3 are supplied to the common driver 30. Accordingly, the regulator circuit 64 and second booster circuit 66 function as the common electrode driving-voltage generator circuit. In addition, although in the embodiment, the driving voltage VC is supplied to the common driver 30 after the impedance conversion, the invention is not restricted to this.

The driving voltages V2, V1, VC, MV1, and MV2 are supplied to the segment driver 40.

Figure 12:
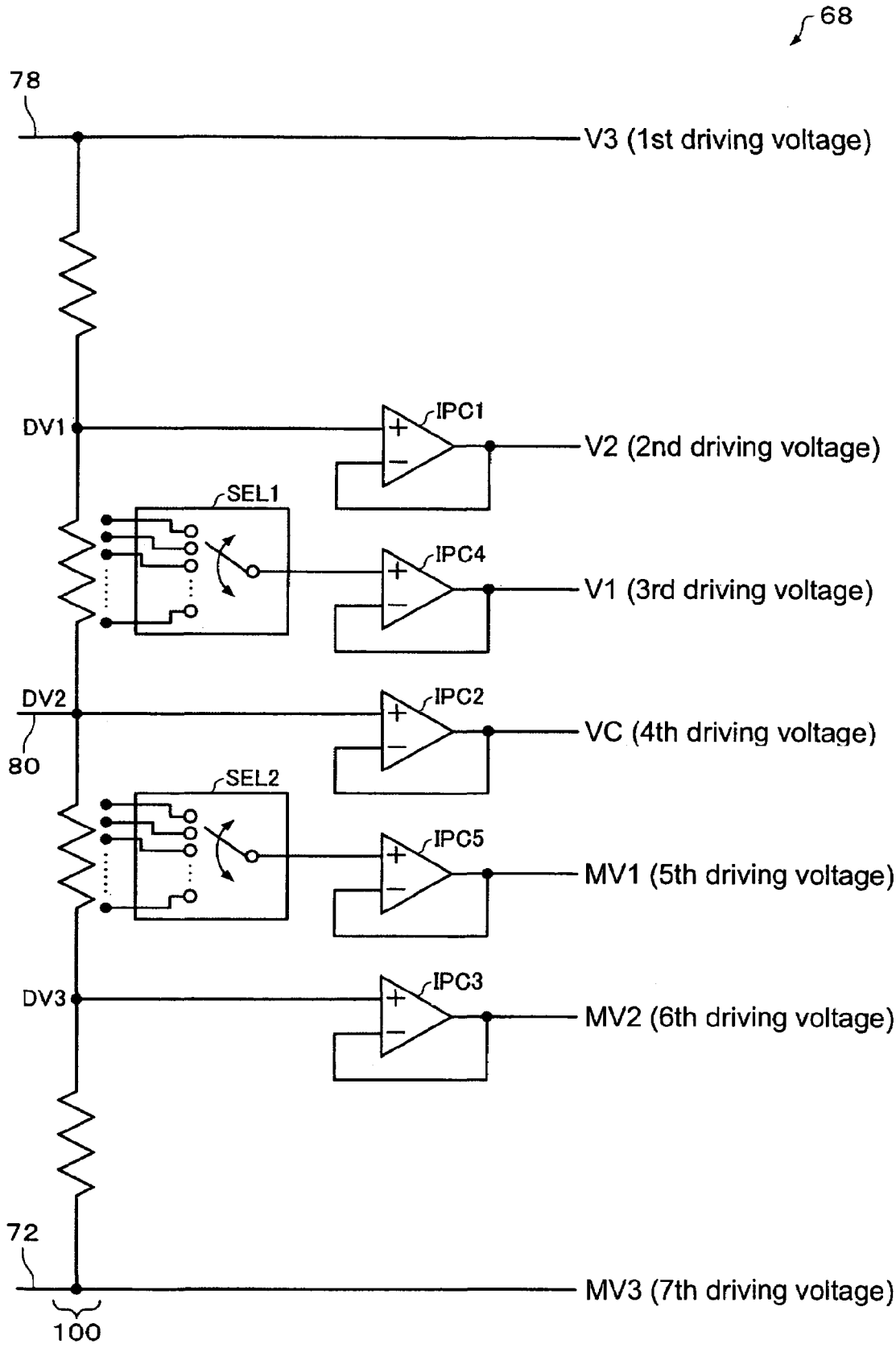
FIG. 12 is a circuit diagram of a configuration example of a multi-level voltage generator circuit of FIG. 10.

FIG. 12 shows a circuit diagram of a configuration example of the multi-level voltage generator circuit 68 of FIG. 10.

The multi-level voltage generator circuit 68 includes a voltage divider circuit 100, first and second selector circuits SEL1 and SEL2, and first through fifth impedance converter circuits IPC1 through IPC5. Because the first and second selector circuits SEL1 and SEL2, and the first through fifth impedance converter circuits IPC1 through IPC5 can generate the driving voltages V2, V1, VC, MV1, and MV2, these may be called the segment electrode driving-voltage generator circuit.

The voltage divider circuit 100 divides the voltage difference between the driving voltage V3 (the first driving voltage) supplied to the first driving voltage supply line 78, and the driving voltage MV3 (the seventh driving voltage) supplied to the system power ground voltage supply line 72, and outputs first through third divided voltages DV1 through DV3. The first divided voltage DV1 is higher than the second divided voltage DV2, and the second divided voltage DV2 is higher than the third divided voltage DV3.

The first divided voltage DV1 is supplied to the input of the first impedance converter circuit IPC1, and the first impedance converter circuit IPC1 outputs the driving voltage V2 (the second driving voltage).

The second divided voltage DV2 is supplied to the input of the second impedance converter circuit IPC2, and the second impedance converter circuit IPC2 outputs the center voltage VC (the fourth driving voltage).

The third divided voltage DV3 is supplied to the input of the third impedance converter circuit IPC3, and the third impedance converter circuit IPC3 outputs the driving voltage MV2 (the sixth driving voltage).

The first selector circuit SEL1 selects and outputs any one of a plurality of divided voltages that are lower than the first divided voltage DV1 and higher than the second divided voltage DV2. Then, the output of the first selector circuit SEL1 is supplied to the input of the fourth impedance converter circuit IPC4, and the fourth impedance converter circuit IPC4 outputs the driving voltage V1 (the third driving voltage).

The second selector circuit SEL2 selects and outputs any one of a plurality of divided voltages that are lower than the second divided voltage DV2 and higher than the third divided voltage DV3. Then, the output of the second selector circuit SEL2 is supplied to the input of the fifth impedance converter circuit IPC5, and the fifth impedance converter circuit IPC5 outputs the driving voltage MV1 (the fifth driving voltage).

Each of such first through fifth impedance converter circuits IPC1 through IPC5 is composed of, for example, an operational amplifier coupled as a voltage-follower. Moreover, the power supply circuit 60 includes first and second selection-control registers for selecting and controlling the first and second selector circuits SEL1 and SEL2, and a selection-control data is set to each of the selection-control registers by the display controller 50. Namely, the first and second selector circuits SEL1 and SEL2 are selected and controlled by the display controller 50.

In this way, the power supply circuit 60 can change and output the output potentials of only the driving voltages V1 and MV1 (the third and fifth driving voltages) out of the driving voltages V2, V1, VC, MV1, and MV2 (the second through sixth driving voltages) in the multi-level voltage generator circuit 68.

Figure 13:
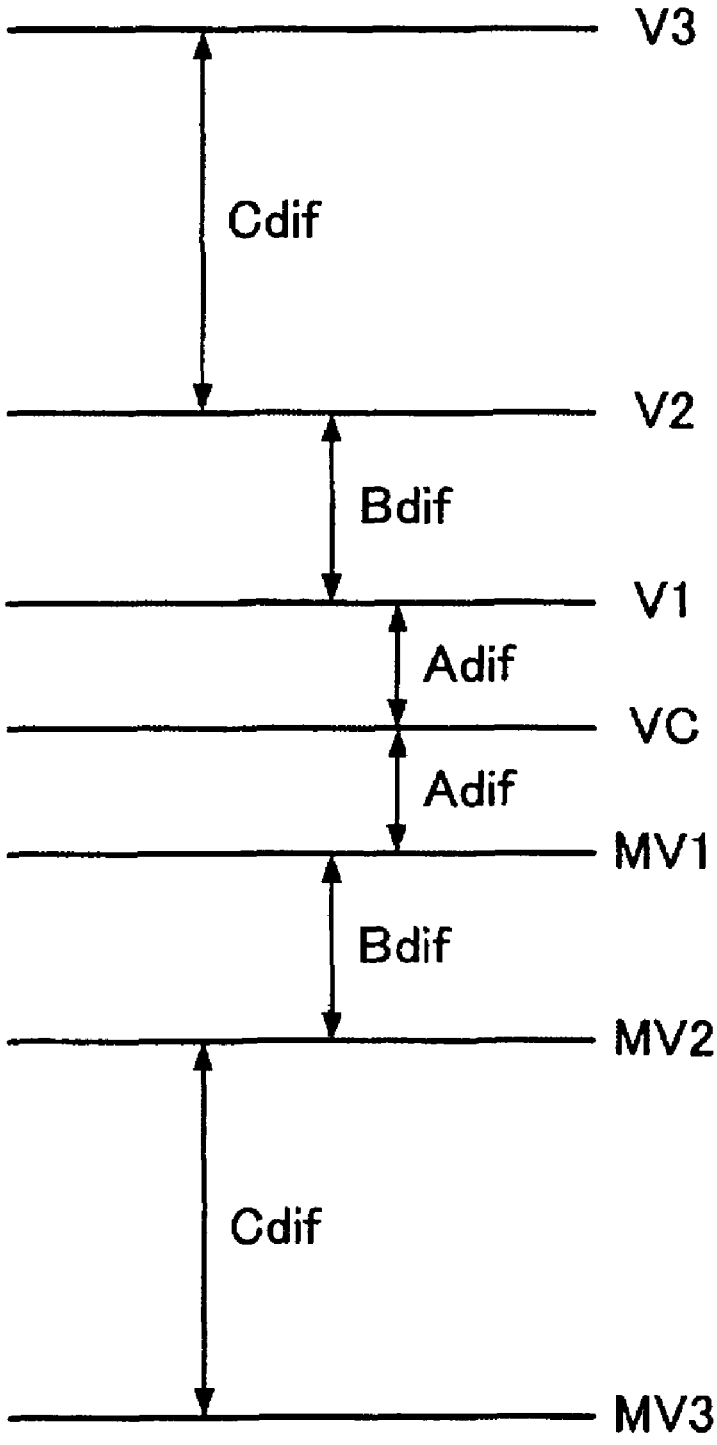
FIG. 13 is an explanatory view of a relationship of the potentials of the driving voltages in the embodiment.

FIG. 13 shows an explanatory view of the relationship of the potentials of the driving voltages in the embodiment.

In FIG. 13, the driving voltage V3 (the first driving voltage) is higher than the driving voltage V2 (the second driving voltage), and the driving voltage MV2 (the sixth driving voltage) is higher than the driving voltage MV3 (the seventh driving voltage).

Then, when the voltage difference between the driving voltage V1 and the center voltage VC (the third and fourth driving voltages) is denoted by Adif, and the voltage difference between the driving voltages V2 and V1 (the second and third driving voltages) is denoted by Bdif, each driving voltage is outputted so that the voltage difference between the center voltage VC and the driving voltage MV2 (the fourth and fifth driving voltages) becomes Adif, and the voltage difference between the driving voltages MV1 and MV2 (the fifth and sixth driving voltages) becomes Bdif. Then, also in changing the potentials of the driving voltages V1 and MV1, each driving voltage is outputted so that the voltage difference between the driving voltage V1 and the center voltage VC (the voltage difference between the third and fourth driving voltages) may equal to the voltage difference between the center voltage VC and the driving voltage MV1 (the voltage difference between the fourth and fifth driving voltages).

Figure 14A:
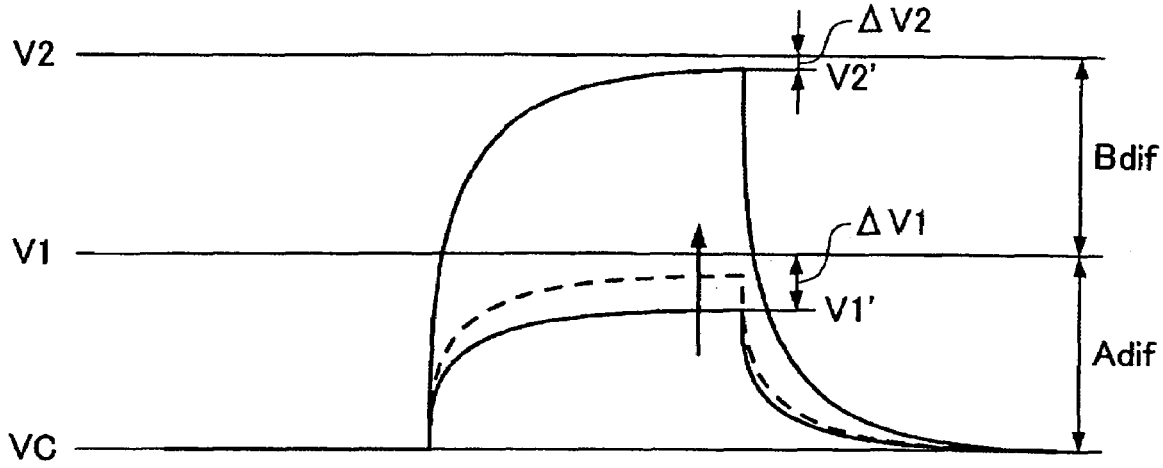
FIG. 14A and FIG. 14B are explanatory views of a method of supplying driving voltages of the embodiment.
Figure 14B:
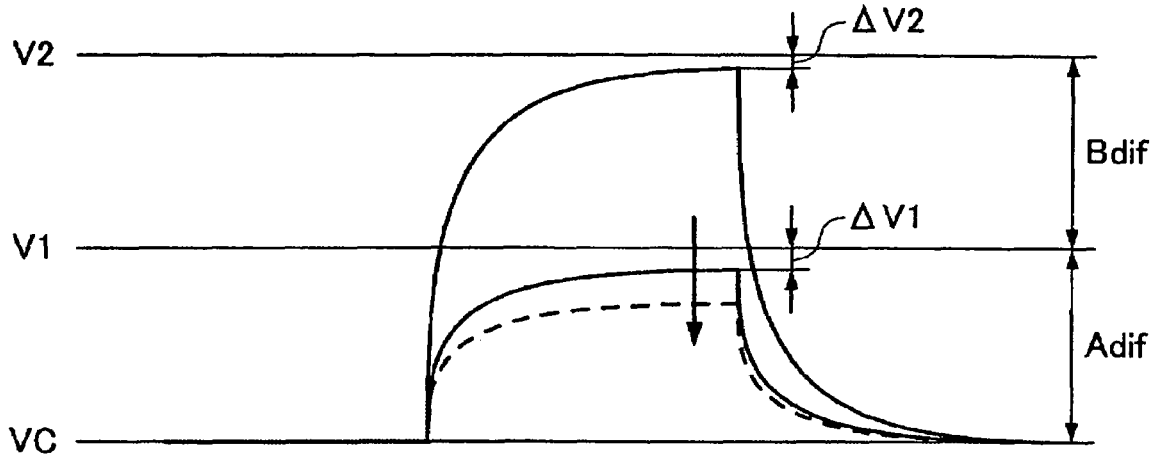

FIG. 14A and FIG. 14B show explanatory views of a method of supplying driving voltages in the embodiment.

Here, attention will be paid to the effective voltage of a pixel where the common electrode COM 1 intersects with the segment electrode SEG1. The effective voltage of this pixel at the time when the segment electrode SEG1 is driven by any one of the driving voltages V2, VC, and MV2 (the second, fourth, and sixth driving voltages) is denoted by Arms. Moreover, the effective voltage of this pixel at the time when the segment electrode SEG1 is driven by any one of the driving voltages V1 and MV1 (the third and fifth driving voltages) is denoted by Arms. These effective voltages can be calculated by the equation (1) when this pixel is turned on, and by the equation (2) when this pixel is turned off.

Then, if the effective voltage Arms is larger than the effective voltage Brms, the output potentials of the driving voltages V1 and MV1 (the third and fifth driving voltages) are changed so that Adif may become larger than Bdif (FIG. 14A).

Moreover, if the effective voltage Arms is smaller than the effective voltage Brms, the output potentials of the driving voltages V1 and MV1 (the third and fifth driving voltages) are changed so that Adif may become smaller than Bdif (FIG. 14B).

In addition, in FIG. 14A and FIG. 14B, it is necessary to compare the effective voltage Arms of the pixel to be turned on with the effective voltage Brms of the pixel to be turned on, or compare the effective voltage Arms of the pixel to be turned off with the effective voltage Brms of the pixel to be turned off.

Because the effective voltage can be adjusted this way, there will be produced no differences in the actual effective voltage applied to the liquid crystal device, depending on the display pattern, and it is possible to avoid the situation where the density will differ, for example, even for the same white display, thereby deteriorating the display quality.

For example, the difference between the ideal driving voltage V2 and the actual driving voltage V2' is denoted by ΔV2, and the difference between the ideal driving voltage V1 and the actual driving voltage V1' is denoted by ΔV1. Then, when the effective voltage Arms is compared with the effective voltage Brms, the comparison results between the effective voltage Arms and the effective voltage Brms may be determined by comparing ΔV1 with ΔV2.

Note that, when the voltage difference between the driving voltages V3 and V2 (the first and second driving voltages) is Cdif, the voltage difference between the driving voltages MV2 and MV3 (the sixth and seventh driving voltages) is also Cdif.

Here, when a bias ratio a is set to $v_3/v_2$ under the condition that the equation (7) is valid, then $V_{ON\ (RMS)}/V_{OFF\ (RMS)}$ calculated by the equations (1) and (2) will become the following equation (8).

$$\frac{V_{ON(RMS)}}{V_{OFF(RMS)}} = \sqrt{\frac{3(2a+1)^2+(2a-1)^2+(N-4)}{3(2a-1)^2+(2a+1)^2+(N-4)}} \tag{8}$$

This equation (8) is the information equivalent to the ratio of the brightness of the turned-on pixel and the turned-off pixel, and can be called the contrast ratio. Accordingly, if the numerator $V_{ON\ (RMS)}$ of the equation (8) is large, and at the same time the denominator $V_{OFF\ (RMS)}$ of the equation (8) is small, the value of the equation (8) will be the maximum value. Namely, at this time, the bias ratio is calculated as follows.

$$a = \frac{\sqrt{N}}{4} \tag{9}$$

Namely, because the bias ratio a will be determined if the line number N of the common electrode is determined, the driving voltages V3 and MV3 wherein the contrast becomes the largest will be determined.

4. Driving Device 4.1 Segment Driver

Figure 15:
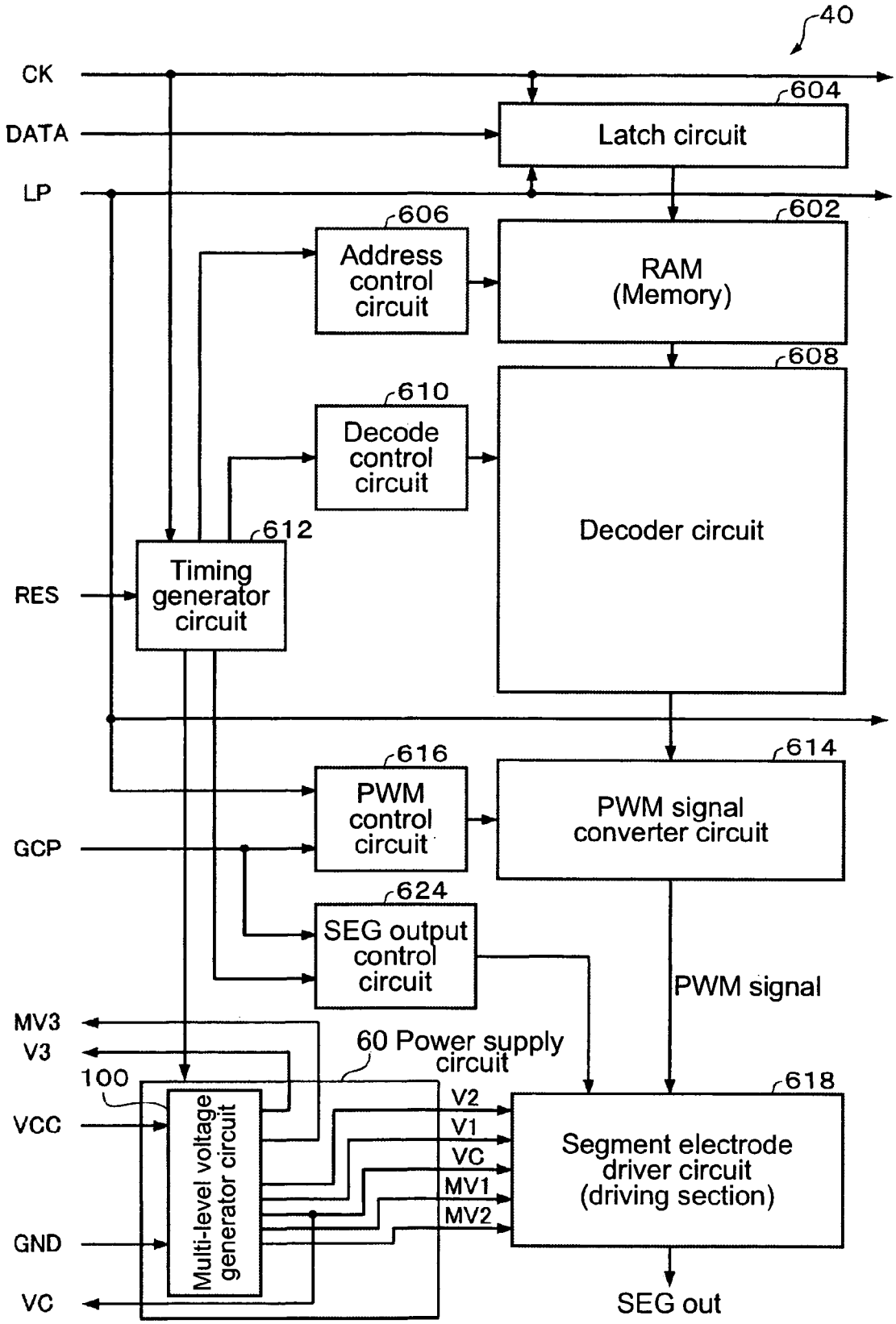
FIG. 15 is a block diagram of a configuration example of the segment driver of FIG. 1.

FIG. 15 shows a block diagram of a configuration example of the segment driver 40 of FIG. 1.

Here, for simplicity of description, a configuration example of only one output portion is shown. However, the same numerals are given to the same portions of FIG. 1, and the description thereof will be omitted suitably.

Moreover, the segment driver 40 may include the above-described power supply circuit 60. In this case, the segment driver 40 supplies the driving voltages V3, VC, and MV3 generated by the power supply circuit 60, to the common driver 30.

The segment driver 40 includes a RAM 602 for storing, for example, one frame of display data, and a latch circuit 604. The latch circuit 604 has a function as a data fetch circuit for writing the display data in the RAM 602, and a function as a line latch. A clock CK used for the display-data fetch, DATA, which is the display data, and a latch pulse LP are inputted to the latch circuit 604.

In the RAM 602, writing control of the display data outputted from the latch circuit 604, and read-out control to a decoder circuit are carried out by an address control circuit 606.

The display data read from the RAM 602 is supplied to a decoder circuit 608. The decoder circuit 608 outputs a decode signal for selecting the driving voltages to be outputted in each field period, in response to the display pattern of the pixel and the scanning pattern of the common electrode based on the display data. The decode control circuit 610 supplies to the decoder circuit 608 the field signal designating each field period, in response to a field display timing. The decoder circuit 608 can decode in synchronization with a polarity inversion timing provided by a polarity inversion signal, which is not shown.

An address control circuit 606 and the decode control circuit 610 are controlled by a timing generator circuit 612. The timing generator circuit 612 defines the timing required for writing control and read-out control of the display data, and the decode control timing of the display data that is read from the RAM 602 by the field signal corresponding to the display timing, with the use of the clock CK and a reset signal RES.

The decode signal from the decoder circuit 608 is supplied to a PWM signal converter circuit 614. The PWM signal converter circuit 614 is controlled by a PWM control circuit 616.

The PWM control circuit 616 can define, for example, corresponding to the decode signal of the decoder circuit 608, the pulse width made of the number of counts of a clock GCP used for the pulse-width modulation, with the use of the PWM signal converter circuit 614. In this case, the count value to be reset by the latch pulse signal LP for each one horizontal-scanning period can be used.

A segment electrode driver circuit (a driver unit, in a broad sense) 618 drives the segment electrode based on the PWM signal. At this time, any one of the driving voltages V2, V1, VC, MV1, and MV2 supplied from the power supply circuit 60 is selected and outputted based on the PWM signal.

The segment electrode driver circuit 618 is controlled by a SEG output control circuit 624. The SEG output control circuit 624 can control the segment electrode driver circuit 618 based on the display timing generated by the timing generator circuit 612, and the clock GCP.

4.2 Common Driver

Figure 16:
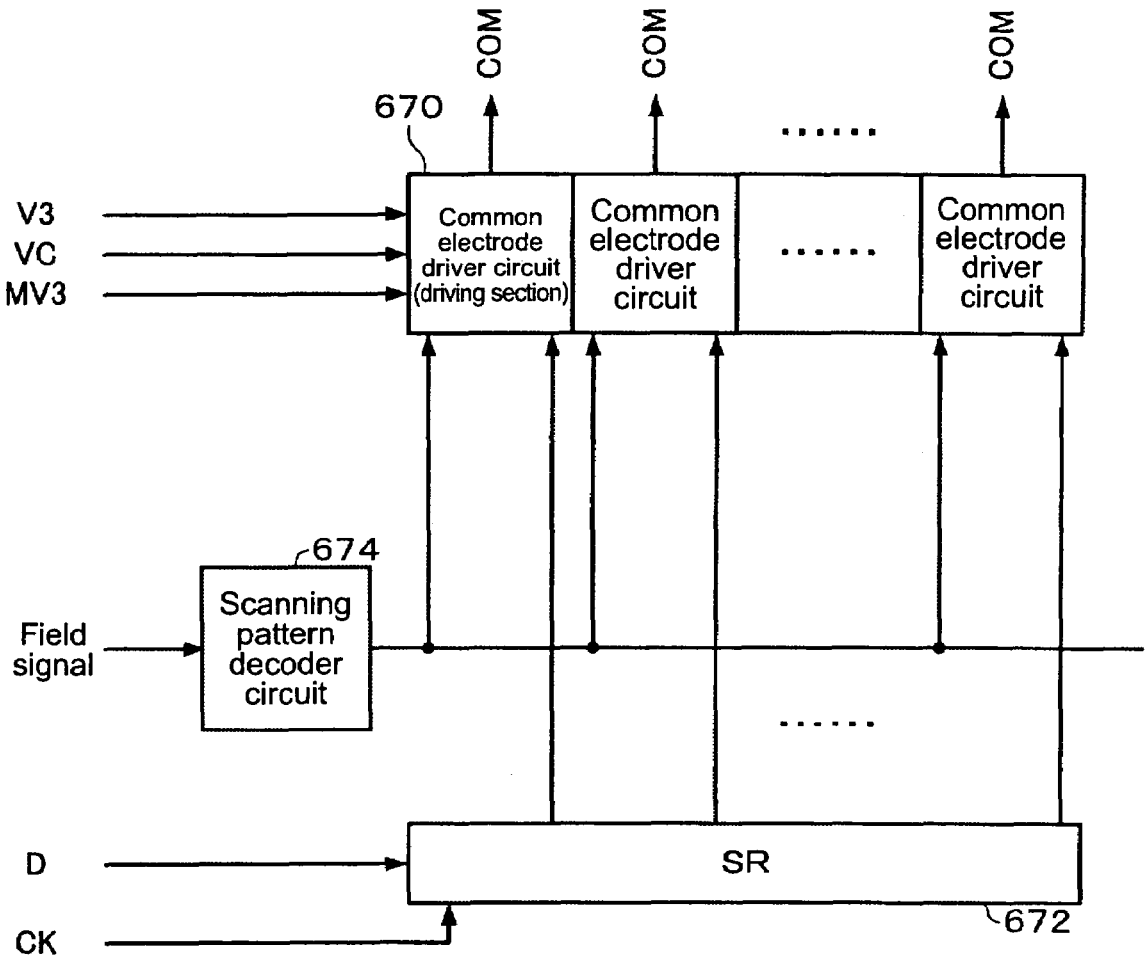
FIG. 16 is a block diagram of a configuration example of a common driver of FIG. 1.

FIG. 16 shows a block diagram of a configuration example of the common driver 30 of FIG. 1.

The common driver 30 has a common electrode driver circuit 670 corresponding to each common electrode. A shift register (SR) 672 is composed of a plurality of flip flops, and each flip flop corresponds to the four lines of common electrodes. Then, a data signal D is shifted based on a clock signal CK. The output of each flip flop of SR 672 is inputted to each common electrode driver circuit. In the selection period based on the output signal of SR672, either of the driving voltages V3 and MV3 is outputted. The driving voltage VC is outputted in the non-selection period.

Moreover, the common driver 30 includes a scanning-pattern decoder circuit 674. The scanning-pattern decoder circuit 674 is a decoder circuit for outputting either of the selection voltages V3 and MV3 based on the field signal that designates each field period. The scanning-pattern decoder circuit 674 can decode in synchronization with the polarity inversion timing provided by the polarity-inversion signal, which is not shown.

In FIG. 15 and FIG. 16, the segment driver 40 includes the power supply circuit 60, however, the invention is not restricted to this. The power supply circuit 60 may be included in the common driver 30, so that the common driver 30 may supply the driving voltages V2, V1, VC, MV1, and MV2 generated by the power supply circuit 60, to the segment driver 40.

5. Electronic Apparatus

Figure 17:
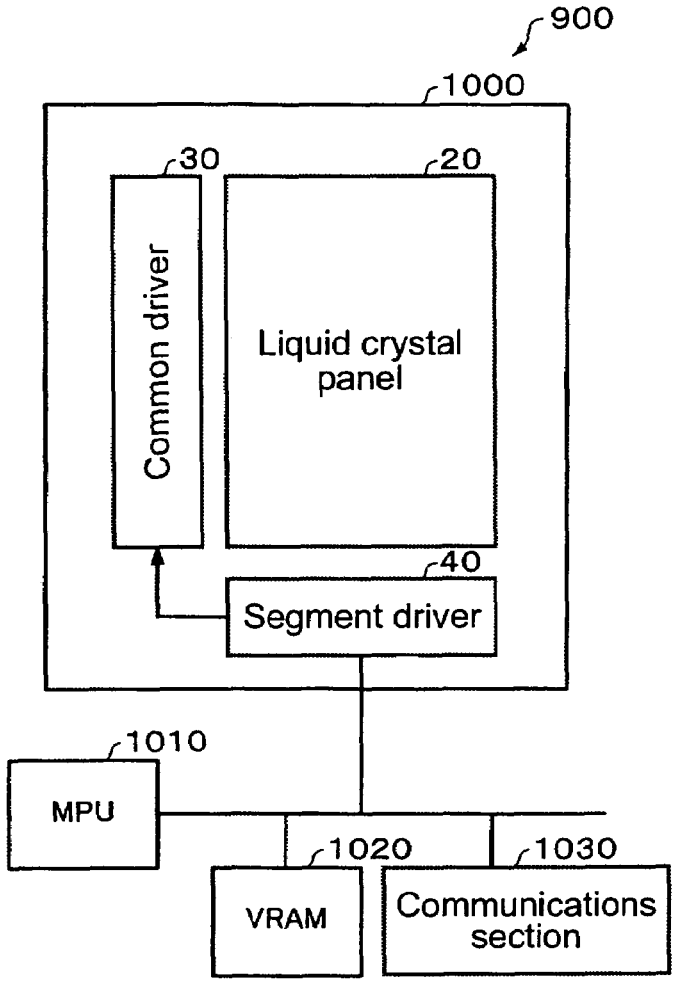
FIG. 17 is a block diagram of a configuration example of an electronic apparatus including the power supply circuit in the embodiment.

FIG. 17 shows a block diagram of a configuration example of an electronic apparatus including the power supply circuit in the embodiment. However, the same numerals are given to the same portions of FIG. 1, and the description thereof will be omitted suitably.

An electronic apparatus 900 shown in FIG. 17 includes a liquid crystal device 1000. The liquid crystal device 1000 includes the liquid crystal panel 20, the common driver 30, and the segment driver 40 shown in FIG. 1. This segment driver 40 includes the power supply circuit 60.

The liquid crystal device 1000 is coupled with a MPU 1010 via a bus. With this bus, a VRAM 1020 and a communications section 1030 are also coupled. The MPU 1010 controls each part via the bus. The VRAM 1020 has, for example, a storage region that corresponds to the pixel of the liquid crystal panel 20 of the liquid crystal device 1000 on a one-to-one basis, and the image data written at random by the MPU 1010 is read sequentially in accordance with the scanning direction.

A communications section 1030 carries out various kinds of control for communications to/from the outside (for example, a host device and other electronic apparatus), and the function thereof can be realized with hardware such as various processors or ASIC for communications, programs, and the like.

In such an electronic apparatus, the MPU 1010 generates various timing signals required for the driving of the liquid crystal panel 20 of the liquid crystal device 1000, and supplies them to the common driver 30 and the segment driver 40 of the liquid crystal device 1000. The segment driver 40 supplies the driving voltages V3, VC, and MV3 to the common driver 30.

With such configuration, it is possible to provide an electronic apparatus capable of preventing deterioration of the display quality in the MLS driving method of simultaneously selecting four lines of common electrodes.

In addition, the invention is not restricted to the above-described embodiments, and various modifications can be made within the spirit and scope of the substance of the invention.

Part of requirements of any claim of the invention could be omitted from a dependent claim which depends on that claim. Moreover, part of requirements of any independent claim of the invention could be made to depend on any other independent claim.

Although only some embodiments of the invention have been described in detail above, those skilled in the art will readily appreciate that many modifications are possible in the embodiments without departing from the novel teachings and advantages of this invention. Accordingly, all such modifications are intended to be included within the scope of this invention.

What is claimed is:

1. A power supply circuit which generates driving voltages for an electro-optic device having a plurality of common electrodes and a plurality of segment electrodes with the use of multi-line driving in which four lines of common electrodes are simultaneously selected, the driving voltages being first through seventh driving voltages in which an i-th ($2 \leqq i \leqq 5$, and i is an integer) driving voltage is higher than an (i+1)th driving voltage, the power supply circuit comprising:

a common electrode driving-voltage generator circuit which generates the first and seventh driving voltages used for selection of the common electrodes at a positive side and a negative side on the basis of the fourth driving voltage; and a segment electrode driving-voltage generator circuit which generates the fourth driving voltage, the second and third driving voltages used for the segment electrodes at the positive side on the basis of the fourth driving voltage, and the fifth and the sixth driving voltages used for the segment electrodes at the negative side on the basis of the fourth driving voltage, wherein the segment electrode driving-voltage generator circuit changes and outputs output potentials of only the third and fifth driving voltages from among the second through sixth driving voltages, while a voltage difference between the third and fourth driving voltages is kept equal to a voltage difference between the fourth and the fifth driving voltages.

2. The power supply circuit according to claim 1, wherein:

the first driving voltage is higher than the second driving voltage;

the sixth driving voltage is higher than the seventh driving voltage; and the second through fifth driving voltages are generated based on divided voltages made by dividing a voltage difference between the first and seventh driving voltages.

3. The power supply circuit according to claim 1, further comprising:

a voltage divider circuit which divides a voltage difference between the first and seventh driving voltages into first through third divided voltages and outputs the first through third divided voltages, wherein the segment electrode driving-voltage generator circuit includes:

a first impedance converter circuit having an input to which the first divided voltage is supplied, the second driving voltage being outputted from the first impedance converter circuit;

a second impedance converter circuit having an input to which the second divided voltage is supplied, the fourth driving voltage being outputted from the second impedance converter circuit;

a third impedance converter circuit having an input to which the third divided voltage is supplied, the sixth driving voltage being outputted from the third impedance converter circuit;

a first selector circuit which is used to select one of divided voltages which are lower than the first divided voltage and higher than the second divided voltage;

a fourth impedance converter circuit having an input to which an output of the first selector circuit is supplied, the third driving voltage being outputted from the fourth impedance converter circuit;

a second selector circuit which is used to select one of divided voltages which are lower than the second divided voltage and higher than the third divided voltage; and a fifth impedance converter circuit having an input to which an output of the second selector circuit is supplied, the fifth driving voltage being outputted from the fifth impedance converter circuit.

4. The power supply circuit according to claim 1, wherein when the voltage difference between the third and fourth driving voltages is denoted by Adif, a voltage difference between the second and third driving voltages by Bdif, the voltage difference between the fourth and fifth driving voltages by Adif, and a voltage difference between the fifth and sixth driving voltages by Bdif, the segment electrode driving-voltage generator circuit changes the output potentials of the third and fifth driving voltages so that Adif becomes larger than Bdif, when an effective voltage Arms of a pixel intersecting with one of the segment electrodes driven by one of the second, fourth, and sixth driving voltages is larger than an effective voltage Brms of a pixel intersecting with one of the segment electrodes driven by one of the third and fifth driving voltages, and changes the output potentials of the third and fifth driving voltages so that Adif becomes smaller than Bdif, when Arms is smaller than Brms.

5. A driving device used for driving an electro-optic device having a plurality of common electrodes and a plurality of segment electrodes, the driving device comprising:

the power supply circuit according to claim 1; and a driving section which drives at least ones of the common electrodes and the segment electrodes by using a driving voltage supplied from the power supply circuit.

6. An electro-optic device, comprising:

a plurality of common electrodes;

a plurality of segment electrodes; and the driving device according to claim 5.

7. An electronic apparatus, comprising:

the power supply circuit according to claim 1.

8. A method of supplying driving voltages that supplies driving voltages for an electro-optic device having a plurality of common electrodes and a plurality of segment electrodes with the use of multi-line driving in which four lines of the common electrodes are simultaneously selected, the driving voltages being first through seventh driving voltages in which an i-th ($2 \leqq i \leqq 5$, and i is an integer) driving voltage is higher than an (i+1)th driving voltage, the method of supplying driving voltages comprising:

supplying the first and seventh driving voltages used for selection of the common electrodes at a positive side and a negative side on the basis of the fourth driving voltage; and supplying the fourth driving voltage, the second and third driving voltages used for the segment electrodes at the positive side on the basis of the fourth driving voltage, and the fifth and sixth driving voltages used for the segment electrodes at the negative side on the basis of the fourth driving voltage, wherein output potentials of only the third and fifth driving voltages from among the second through sixth driving voltages are changed and outputted, while a voltage difference between the third and fourth driving voltages is kept equal to a voltage difference between the fourth and the fifth driving voltages.

9. The method of supplying driving voltages according to claim 8, wherein when the voltage difference between the third and fourth driving voltages is denoted by Adif, a voltage difference between the second and third driving voltages by Bdif, the voltage difference between the fourth and fifth driving voltages by Adif, and a voltage difference between the fifth and sixth driving voltages by Bdif, the output potential of the third and fifth driving voltages are changed so that Adif becomes larger than Bdif, when an effective voltage Arms of a pixel intersecting with one of the segment electrodes driven by one of the second, fourth, and sixth driving voltages is larger than an effective voltage Brms of a pixel intersecting with one of the segment electrodes driven by one of the third and fifth driving voltages, and the output potentials of the third and fifth driving voltages are changed so that Adif becomes smaller than Bdif, when Arms is smaller than Brms.

* * * * *